US007252055B2

(12) United States Patent
Tani et al.

(10) Patent No.: US 7,252,055 B2
(45) Date of Patent: Aug. 7, 2007

(54) VALVE CONTROLLER

(75) Inventors: Hideji Tani, Kakamigahara (JP); Akihiko Takenaka, Anjo (JP); Yoshihiro Sato, Nagoya (JP)

(73) Assignees: DENSO CORPORATION, Kariya, Aichi-pref. (JP); Toyota Jidosha Kabushiki Kaisha, Toyota, Aichi-pref. (JP)

( * ) Notice: Subject to any disclaimer, the term of this patent is extended or adjusted under 35 U.S.C. 154(b) by 0 days.

(21) Appl. No.: 11/111,780

(22) Filed: Apr. 22, 2005

(65) Prior Publication Data

US 2005/0235938 A1 Oct. 27, 2005

(30) Foreign Application Priority Data

Apr. 23, 2004 (JP) ..... 2004-128268

(51) Int. Cl.
*F01L 1/34* (2006.01)

(52) U.S. Cl. ..... 123/90.15; 123/90.16; 123/90.17; 123/90.11; 701/105; 701/107; 701/112; 701/113

(58) Field of Classification Search ..... 123/90.15
See application file for complete search history.

(56) References Cited

U.S. PATENT DOCUMENTS

| | | | | |
|---|---|---|---|---|
| 4,274,141 | A * | 6/1981 | Tokuda et al. | 701/113 |
| 5,349,929 | A | 9/1994 | Shimizu et al. | 123/90.16 |
| 5,353,775 | A * | 10/1994 | Yamashita et al. | 123/686 |
| 6,260,535 | B1 * | 7/2001 | Froeschl et al. | 123/198 DB |
| 6,378,475 | B2 * | 4/2002 | Takenaka et al. | 123/90.17 |
| 6,474,291 | B2 * | 11/2002 | Collins et al. | 123/198 DB |
| 2003/0144778 | A1 | 7/2003 | Miyano | 701/29 |

FOREIGN PATENT DOCUMENTS

| | | |
|---|---|---|
| JP | 4-105906 | 9/1992 |
| JP | 11-324625 | 11/1999 |

* cited by examiner

*Primary Examiner*—Thomas Denion
*Assistant Examiner*—Kyle M. Riddle
(74) *Attorney, Agent, or Firm*—Nixon & Vanderhye P.C.

(57) ABSTRACT

A valve controller includes a detector detecting a shutdown command signal to shutdown an engine, a driving circuit for driving a motor, and a power source controller. The power source controller turns on the driving circuit until the predetermined period has passed since the shutdown command signal is detected. Thus, the valve controller adjusts the valve opening/closing character in such a manner as to be suitable to an engine condition.

16 Claims, 19 Drawing Sheets

VALVE CONTROLLER

CROSS REFERENCE TO RELATED APPLICATIONS

This application is based on and incorporates herein by reference Japanese Patent Application No. 2004-128268 filed on Apr. 23, 2004, the disclosure of which is incorporated herein by reference.

FIELD OF THE INVENTION

The present invention relates to a valve controller, which adjusts a valve opening/closing character of an internal combustion engine, utilizing a motor torque. The internal combustion engine is referred to as an engine hereinafter.

BACKGROUND OF THE INVENTION

JP-U-4-105906A shows a valve-timing controller which utilizes a motor torque. JP-11-324625A shows a valve lift controller which utilizes a motor torque. In these controllers, an electric power source of a driving circuit is turned ON from the time an engine-start signal is generated until an engine-stop signal is generated, otherwise the electric power source is turned OFF. A rotation sensor detects engine rotation speed to output an engine speed signal, on which a control circuit generates a control signal. The driving circuit supplies an electric current to the motor according to the control signal.

The engine continues to run by inertial force for a moment after the engine-stop signal is generated. At this time, the motor receives no electric current from the electric power source which the driving circuit operates. That is, the driving circuit supplies no electric current to the motor after the engine-stop signal is generated, so that the motor serves a load that generates a deviation in the valve opening/closing character. Thus, it is difficult to later realize a proper valve character required for starting the engine.

As described above, the driving circuit cannot supply the electric current to the motor before the engine-starting signal is generated. Thereby, if the valve opening/closing character is deviated before the engine-start signal is generated, the valve opening/closing character cannot be adjusted to the proper character for starting the engine.

The rotation sensor detecting engine rotation speed inherently has a lower-limit in which the rotation sensor can detects the lowest engine rotation speed, so that the rotation sensor outputs no engine speed signal for a moment after the engine is started. Until the engine speed signal is generated, the control circuit generates no control signal and the driving circuit conducts no activation of the motor. Thus, the motor again serves a load that generates a deviation in the valve opening/closing character, so that it is difficult to realize the proper valve character that is required for starting the engine.

SUMMARY OF THE INVENTION

The present invention is made in view of the foregoing matter and it is an object of the present invention to provide a valve controller capable of realizing the proper valve opening/closing timing according to the engine condition.

A valve controller of the present invention includes a detecting means for detecting a shutdown command to the internal combustion engine; a driving circuit energizing a motor; and a power source control means for turning on/off a power source of the driving circuit after the detecting means detects the shutdown command.

BRIEF DESCRIPTION OF THE DRAWINGS

The above and other objects, features, and advantages of the present invention will become more apparent from the following detailed description made with reference to the accompanying drawings, in which like parts are designated by like reference number and in which.

DETAILED DESCRIPTION OF THE PREFERRED EMBODIMENTS

An embodiment of the present invention will be described hereinafter with reference to the drawings.

First Embodiment

Figure 2:
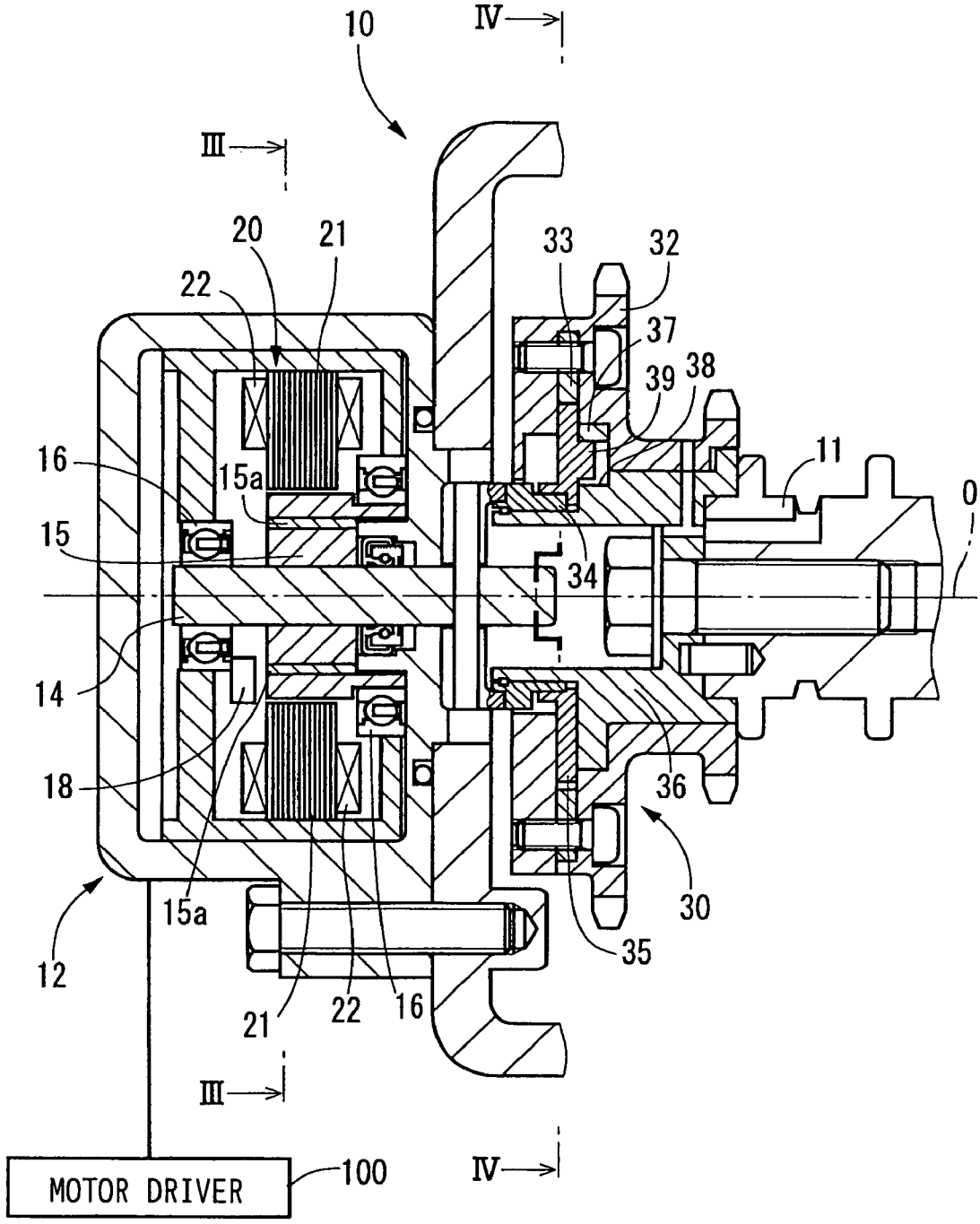
FIG. 2 is a cross sectional view of a valve timing controller according to the first embodiment.
Figure 3:
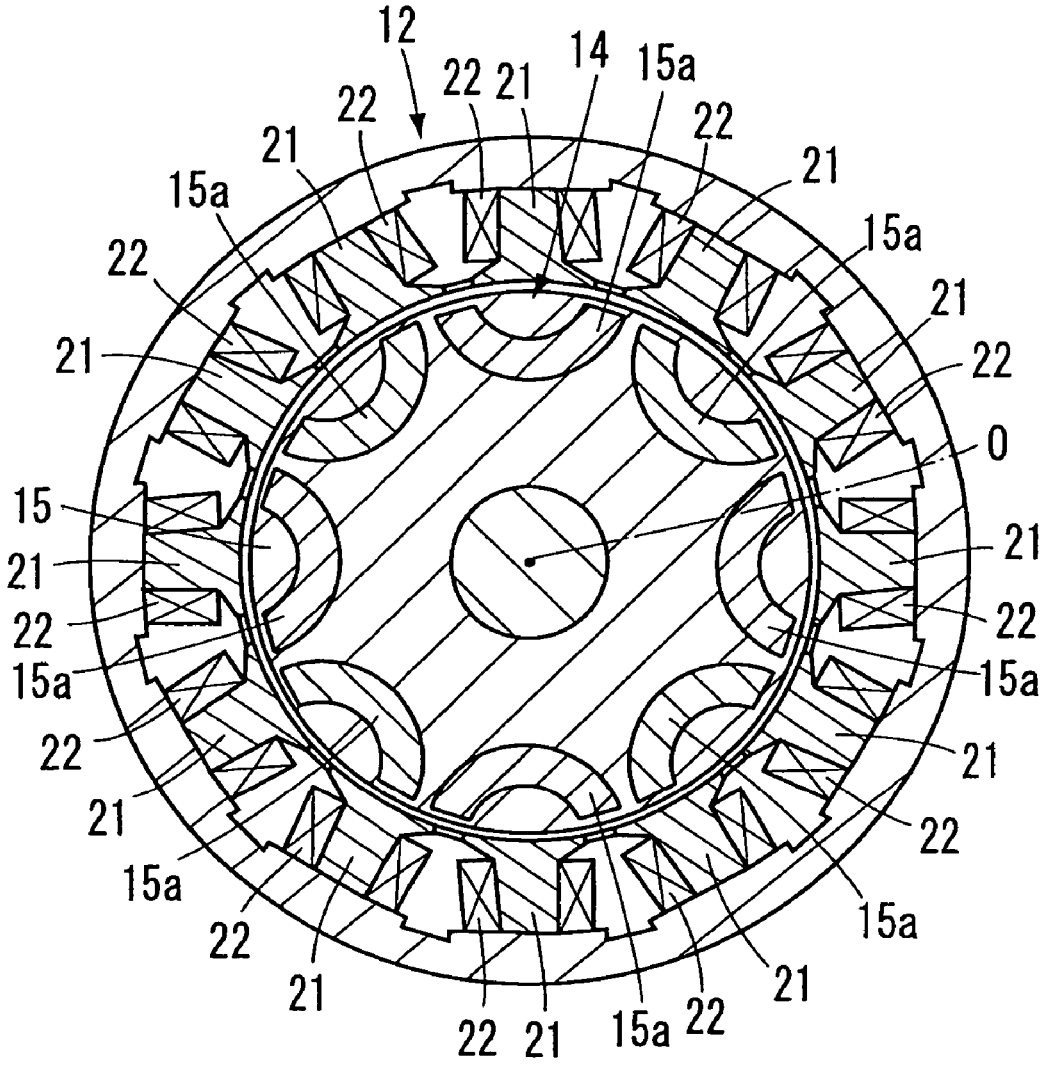
FIG. 3 is a cross sectional view of the valve timing controller taken along the line III-III in FIG. 2.
Figure 4:
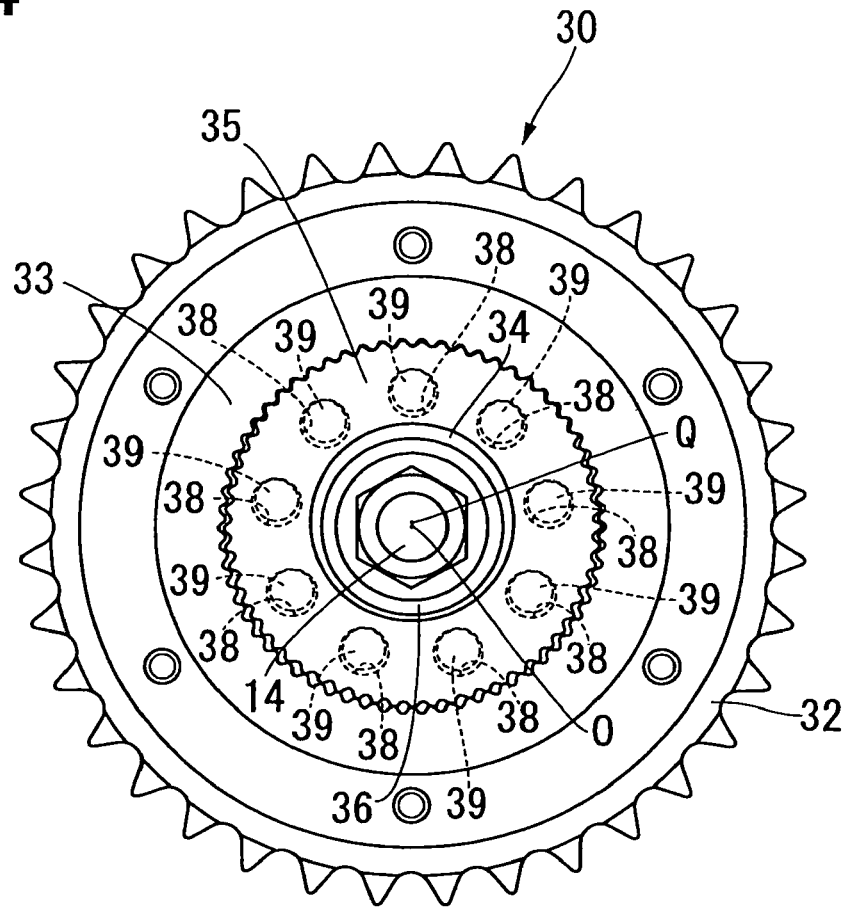
FIG. 4 is a cross sectional view of the valve timing controller taken along the line IV-IV in FIG. 2.

Referring to FIGS. 2 to 4, a first embodiment, which is applied to a valve-timing controller, is described hereinafter. The valve-timing controller is referred to as VTC hereinafter. The VTC 10 equipped with an engine of a vehicle changes valve timing of an intake valve and/or an exhaust valve, which is one valve opening/closing character, utilizing rotational torque of a motor 12.

A structure of the motor 12 is described in detail below.

As shown in FIGS. 2 and 3, the motor 12 is a three-phase brushless motor having a motor shaft 14, bearings 16, Hall effect elements 18 and a stator 20. The motor shaft 14 is rotationally supported by a pair of bearings 16 around an axis "O" in a normal and reverse direction. In the present embodiment, a clockwise direction of the motor shaft 14 in FIG. 3 is referred to as a normal direction, and counterclockwise direction is referred to as a reverse direction. A rotor 15 is provided on the motor shaft 14 and has a plurality of magnets 15*a* therein. Each of magnets 15*a* is disposed at a regular interval around the axis "O" in such a manner that a magnetic pole of the magnet 15*a* is opposite to a magnetic pole generated in an outer wall of the rotor 15. Three Hall effect elements are disposed at a vicinity of the rotor 15. Each of the Hall effect elements 18 generates digital signals as detected signals of which voltage is increased or decreased according to whether the position of the magnet 15*a* is in a predetermined angle range, the magnet 15*a* generating a North pole in the outer wall of the rotor 15.

Figure 5:
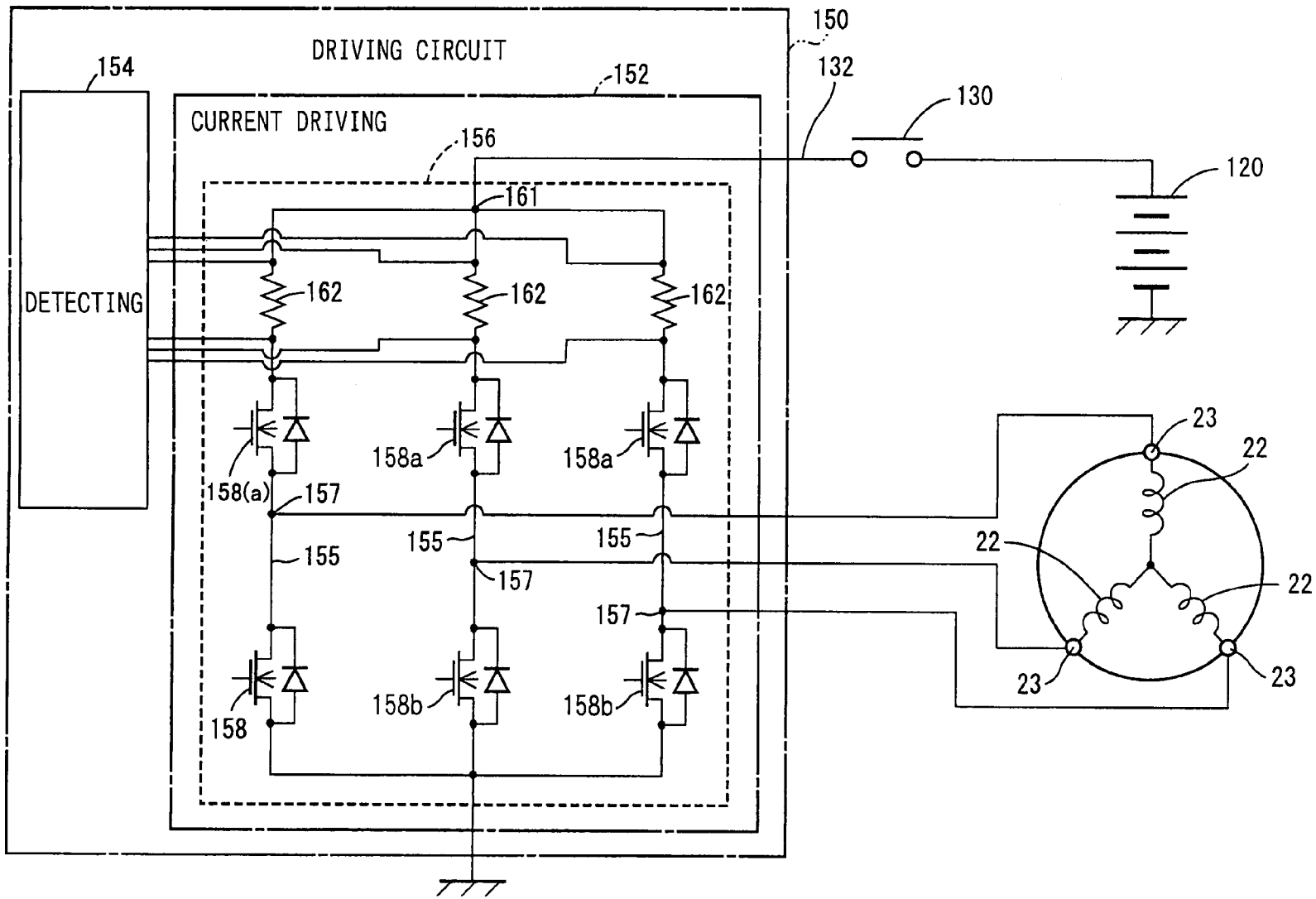
FIG. 5 is circuit diagram showing an essential part of a current driving part according to the first embodiment.

The stator 20 is disposed around the motor shaft 14. The stator 20 has twelve cores 21 which are disposed at regular intervals around the axis "O" and on each of which a coil 22 is wound. As shown in FIG. 5, the coils 22 are connected in the star connection at ends and are connected to a driving circuit 150 of a motor driver 100 at the other ends 23. Each of coils 22 generates a rotational magnetic field around the motor shaft 14 in a clockwise direction or counterclockwise direction. When a clockwise magnetic field is generated, a normal direction torque is applied to the motor shaft 14, with the magnets 15*a* receiving an interactive action in this magnetic field. Similarly, when a counterclockwise magnetic field is generated, a reverse direction torque is applied to the motor shaft 14.

A phase changing mechanism 30 of the VTC 10 is described hereinafter.

As shown in FIGS. 2 and 4, the phase changing mechanism 30 includes a sprocket 32, a ring gear 33, an eccentric shaft 34, a planetary gear 35, and an output shaft 36.

The sprocket 32 is provided on the same axis of the output shaft 36, and rotates around the axis "O" in the same direction as the motor shaft 14. When a driving torque of the crankshaft of the engine is transferred to the sprocket 32 through a chain belt, the sprocket 32 rotates clockwise around axis "O" in FIG. 4, keeping a rotational phase relative to the crankshaft. That is, the sprocket 32 functions as a rotating body rotating in synchronization with the crankshaft. The ring gear 33 is an internal gear, and is coaxially fixed on the inside of the sprocket 32 to rotate together.

The eccentric shaft 34 is directly connected to the motor shaft 14 in such a manner that the outer wall is eccentric to the axis "O". The planetary gear 35 is an external gear, and is disposed in the inside of the ring gear 33 while engaging the teeth thereof with the teeth of the ring gear 33. The planetary gear 35 is coaxially supported by the eccentric shaft 34 and rotates around an eccentric axis "Q". The output shaft 36 is coaxially connected to the camshaft 11 by a bolt to rotate around the axis "O" with the camshaft 11. The output shaft 36 has an engaging plate 37 which is a disk-shaped plate having the center axis "O". The engaging plate 37 has a plurality of engaging holes 38 which are formed at regular intervals around the axis "O". The planetary gear 35 has nine engaging projections 39 around the eccentric axis "Q" which are engaged with the engaging holes 38 individually.

When the motor shaft 14 does not rotate relative to the sprocket 32, the planetary gear 35 rotates clockwise in FIG. 4 with the sprocket 32 while maintaining the engaging position with the ring gear 33. Because the engaging projections 39 urge the inner surface of the engaging holes 38, the output shaft 36 rotates clockwise without relative rotation to the sprocket 32 by which a rotational phase of the camshaft 11 relative to the crankshaft is maintained.

When the motor shaft 14 rotates counterclockwise relative to the sprocket 32, the planetary gear 35 rotates clockwise relative to the eccentric shaft 34 to change engaging position with the ring gear 33. At this moment, the urging force by which the engaging projections 39 urge the inner surface of the engaging holes 38 increases, so that the rotational phase of the output shaft 36 is advanced relative to the sprocket 32. That is, the rotational phase of the camshaft 11 relative to the crankshaft is advanced and the valve timing is advanced.

When the motor shaft 14 rotates clockwise relative to the sprocket 32, the planetary gear 35 rotates counterclockwise relative to the eccentric shaft 34 to change engaging position with the ring gear 33. At this moment, the urging force by which the engaging projections 39 counterclockwise urge the inner surface of the engaging holes 38 increases, so that the rotational phase of the output shaft 36 is retarded relative to the sprocket 32. That is, the rotational phase of the camshaft 11 relative to the crankshaft is retarded and the valve timing is retarded.

A structure of the motor driver 100 of the VTC 10 is described hereinafter. With respect to voltage of digital signals, the high voltage is referred to as H-level, and the low voltage is refereed to as L-level hereinafter.

Figure 6:
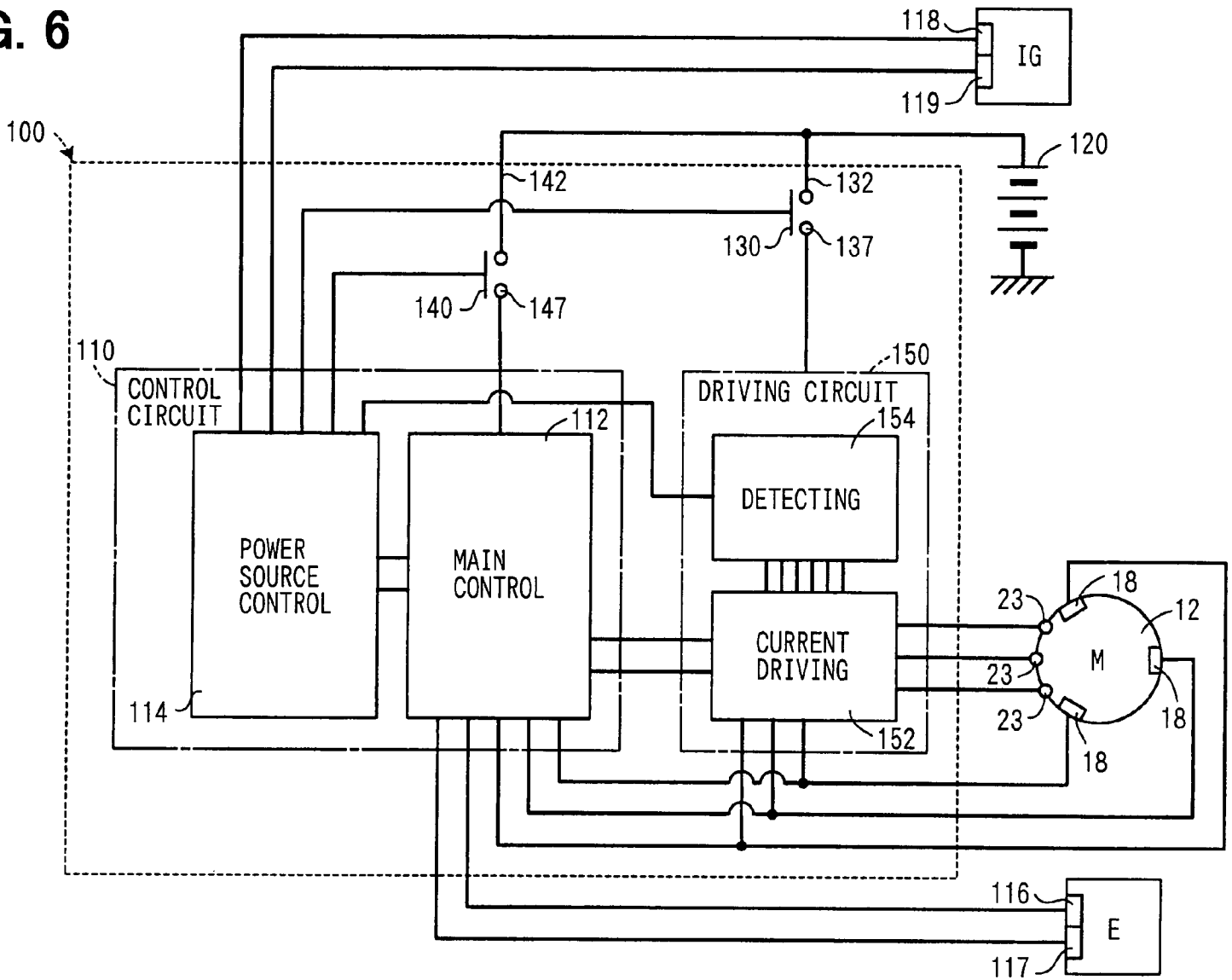
FIG. 6 is a block diagram of the motor driver according to the first embodiment.

As shown in FIG. 6, the motor driver 100 includes a control circuit 110, a first switch 130, a second switch 140, and a driving circuit 150, which are disposed in a proper positions, although FIG. 2 schematically illustrates the motor driver 100 is disposed outside the motor 12.

The control circuit 110 includes a main control part 112 and a power source control part 114. The main control part 112 controls ignition timing, a fuel injection and the like of the engine, and generates a command signal which is sent to the power source control part 114. The main control part 112 sets a control target to drive the motor 12 in such a manner that a proper valve timing for the engine condition is conducted. The control target is at least one of a target rotational speed of the motor shaft 14, a target variation amount of the rotational speed of the motor shaft 14, a rotational direction of the motor shaft 14, and a load current of the motor 12. The main control part 112 generates digital signals indicative of the control target. The single main control signal can indicate the single control target, or a plurality of control targets. The main control signal corresponds to a control signal of the present invention.

The main control part 112 is electrically connected to a first rotation speed sensor 116 to receive a first rotation speed signal indicative of a rotational speed of the crankshaft by its frequency. The main control part 112 is electrically connected to a second rotation speed sensor 117 to receive a second rotation speed signal indicative of a rotational speed of the camshaft 11 by its frequency. The first and the second rotation speed signal can be digital signals or analog signals. The main control part 112 is connected to three Hall effect elements 18 to receive detected signals by the Hall effect elements.

The power source control part 114 generates command signals for the main control part 112. The power source control part 114 is electrically connected to a switch sensor 118 which detects on-off position of the ignition switch. The switch sensor 118 sends a digital signal in H-level with ignition switch on, and sends a digital signal in L-level with ignition switch off. The power source control part 114 is electrically connected to a key-sensor 119 which detects whether an ignition key is inserted into a key hole. The key-sensor 119 sends a digital signal in H-level with the key inserted, and sends a digital signal in L-level with the key not inserted. The power source control part 114 receives electricity from a battery 120 when the signal from the key-sensor 119 is in H-level, or always receives electricity from the battery 120.

The power source control part 114 generates a first power source control signal to activate the drive circuit 150. The first power source control signal in H-level turns on the power source of the driving circuit 150, and the first power source control signal in L-level turns off the power source of the driving circuit 150. The power source control part 114 generates a second power source control signal to activate the main control part 112. The second power source signal in H-level turns on the power source of the main control part 112, and the second power source signal in L-level turns off the power source of the main control part 112.

The first switch 130 includes an electromagnetic relay having mechanical contacts, and is disposed on an electrical power line 132 connecting the battery 120 and the driving circuit 150. The first switch 130 is connected to the power source control part 114 to receive the first power source control signal generated by the power source control part 114. When the first power source control signal is in H-level, the first switch 130 is turned on to permit the electric power supply from the battery 120 to the driving circuit 150, so that the driving circuit 150 is activated. When the first power source control signal is in L-level, the first switch 130 is turned off to stop the electric power supply from the battery 120 to the driving circuit 150, so that the driving circuit 150 is deactivated.

The second switch 140 includes an electromagnetic relay having mechanical contacts, and is disposed on an electrical power line 142 connecting the battery 120 and the main control part 112. The second switch 140 is connected to the power source control part 114 to receive the second power source control signal generated by the power source control part 114. When the second power source control signal is in H-level, the second switch 140 is turned on to permit the electric power supply from the battery 120 to the main control part 112, so that the main control part 112 is activated. When the second power source control signal is in L-level, the second switch 140 is turned off to stop the electric power supply from the battery 120 to the main control part 112, so that the main control part 112 is deactivated.

The driving circuit 150 comprises a current driving part 152 and a detecting part 154.

As shown in FIG. 5, the current driving part 152 includes a bridge circuit 156 in which each of three arms 155 is connected to terminal 23 of the motor 12. Each one end of the arms 155 is connected to the electrical power line 132, and the other end is grounded. There are provided two switching elements 158*a*, 158*b*, such as field-effect transistor, on each arm 155 in such a manner that two switching elements 158*a*, 158*b* sandwich a connecting point 157 in which the arm 155 is connected to the terminal 23 of the motor 12.

As shown in FIG. 6, the current driving part 152 is electrically connected to the main control part 112 to receive the main control signal generated by the main control part 112. The current driving part 152 is connected to three Hall effect elements 18 to receive the detected signals. The current driving part 152 establishes switching patterns according to the main control signal and the detected signal, and turns on/off the switching elements 158*a*, 158*b* according to the switching patterns. Thereby, the motor 12 is activated to realize the control target represented by the main control signal.

A resistor element 162 is respectively disposed on each arm 155 between the switching element 158*a* and a connecting point 161 to which the electrical power line 132 is electrically connected.

The detecting part 154 is connected to both ends of the resistor element 162 to detect current passing through the resistor element 162, which is indicative of current condition of the motor 12. The detecting part 154 is electrically connected to the power source control part 114 to generate digital signals indicative of the current passing through the resistor element 162 as a monitor signal to be sent to the power source control part 114.

The operation of the motor driver 100 is described hereinafter. A valve timing in cranking the engine is referred to as a cranking valve timing, and a valve timing right after the engine is started is referred to as an after-start valve timing.

Figure 1:
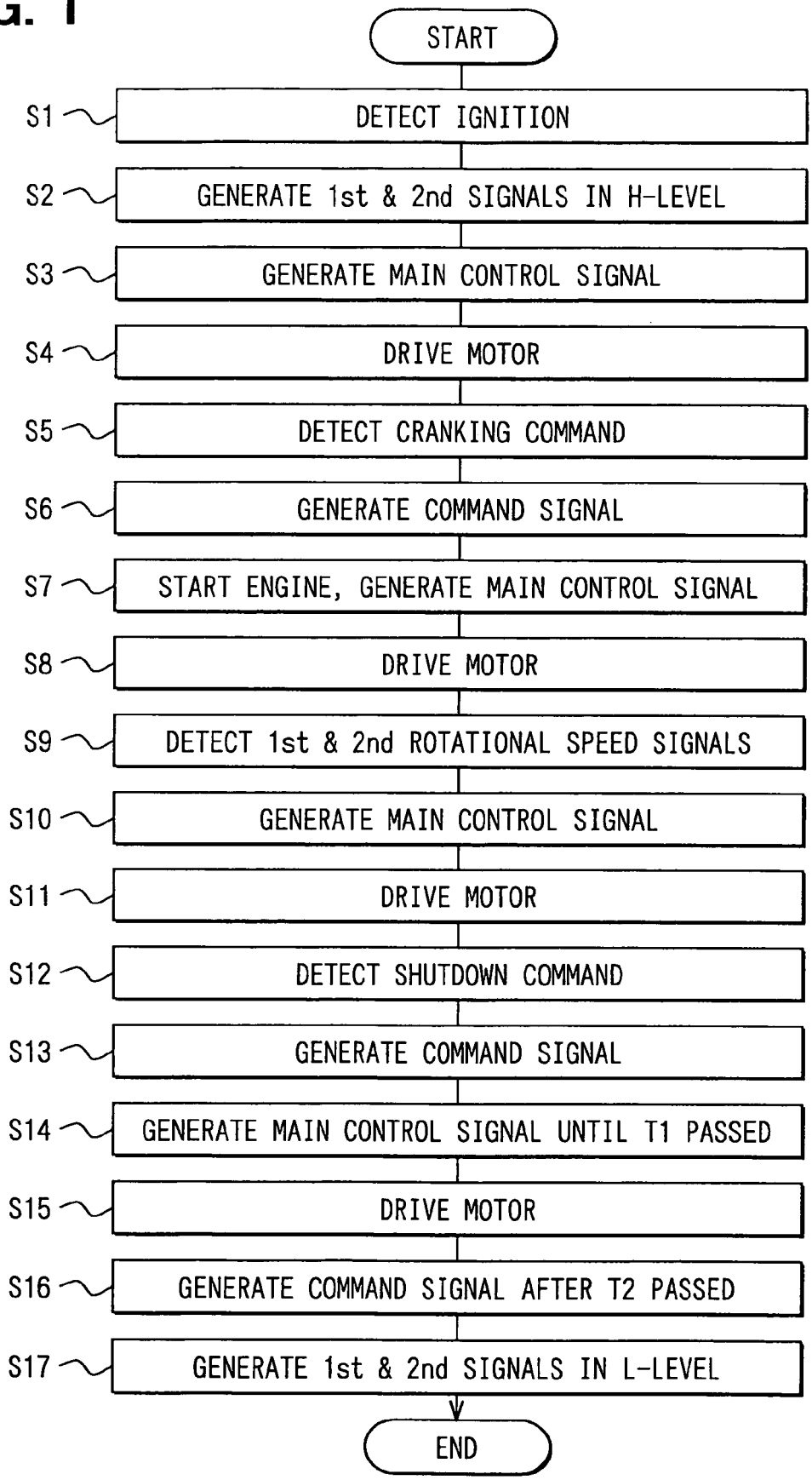
FIG. 1 is a flowchart showing an operation of the motor driver according to a first embodiment.

FIG. 1 is a flowchart showing the operation of the motor driver 100. When the ignition key is inserted into the ignition keyhole while the engine is off, the power source control part 114 receives H-level signal from the key-sensor 119 to determine that ignition key is inserted to the ignition keyhole in step S1. The power source control part 114 generates the first power source control signal in H-level and the second power source control signal in H-level in step S2, which cause the first and the second switch 130, 140 to be turned on, so that the driving circuit 150 and the main control part 112 are energized. Each power source of the driving circuit 150 and the main control part 112 is maintained on until a process in step S17 is executed or a failsafe operation is executed.

In step S3, the energized main control part 112 generates the main control signal until a process in step S7 is executed. The main control part 112 establishes the control target to realize the cranking valve timing based on the detected signals by the Hall effect elements 18, and then generates the main control signal indicative of the control target. The current driving part 152 drives the motor 12 according to the main control signal in step S4 in such a manner as to bring the rotational phase of the output shaft 36 relative to the sprocket 32 into the cranking valve timing by the phase changing mechanism 30.

When the ignition is turned on, the power source control part 114 receiving the H-level signal from the switch sensor 18 determines that a cranking command is detected in step S5. In step S6, the power control part 114 generates and sends a command signal to the main control part 112. The main control part 112 starts the ignition and the fuel injection of the engine, and generates the main control signal until a process in step S10 is executed in step S7. At the same time, the main control part 112 establishes the control target to realize the after-start valve timing according to the detected signals by the Hall effect elements 18, and generates the main control signal indicative of the control target. In step S8, the current driving part 152 receiving the main control signal activates the motor 12 based on the main control signal in such a manner as to bring the rotational phase of the output shaft 36 relative to the sprocket 32 into the after-start valve timing by the phase changing mechanism 30.

In step S9, after the engine is started, when the rotation speeds of the crankshaft and the camshaft 11 are lower than the lower limit of the detected signal by the first rotation speed sensor 116 and the second rotation speed sensor 117, The main control part 112 receives and detects the first rotation speed signal and the second rotation speed signal. At this time, the main control part 112 detects a variation in voltage of the signals from the first rotation speed sensor 116 and the second rotation speed sensor 117 to determine the first and the second rotation speed signal are detected. When both the first and the second rotation speed signal are detected, the main control part 112 generates the main control signal to realize proper valve timing in step S10. The current driving part 152 drives the motor 12 according to the control signal in step S11. The rotational phase of the output shaft 36 relative to the sprocket 32 is brought into or kept in a rotational phase to realize proper valve timing by the phase changing mechanism 30.

When the ignition is turned off, the power source control part 114 receiving the L-level signal from the switch sensor 18 determines that a shutdown command is detected in step S12. In step S13, the power control part 114 generates and sends a command signal to the main control part 112. The main control part 112 terminates the ignition and the fuel injection of the engine with the engine running by inertia thereof, and generates the main control signal until a predetermined period T1 has been elapsed in step S14. At the same time, the main control part 112 establishes the control target to realize the cranking valve timing according to the first and the second rotation speed signal or the detected signals by the Hall effect elements 18, and generates the main control signal indicative of the control target. The predetermined period T1 is longer than the period from the time when the ignition and the fuel injection are terminated to the engine running at a maximum speed to the time when the engine is completely stopped. The period T1 is pre-stored in the main control part 112. In step S15, until the period T1 has passed, the current driving-part 152 receiving the main control signal activates the motor 12 based on the main control signal in such a manner that the rotational phase of the output shaft 36 relative to the sprocket 32 is brought into and kept in the cranking valve timing by the phase changing mechanism 30.

When a predetermined period T2 has elapsed since the command signal is generated in step S13, the main control part 112 generates and sends a command signal to the power source control part in step S16. The period T2 is longer than the period T1 in which current is supplied to the motor 12 based on the main control signal, and is stored in the main control part 112. The power source control part 114 receives the command signal to generate the first and the second power source signal in L-level in step S17. This causes the first switch 130 and the second switch 140 to open the contacts 137, 147 simultaneously, so that the power source of the driving circuit 150 and the main control part 112 are turned off. According the present embodiment, since the period T2 is longer than the period T1, the power source of the driving circuit 150 and the main control part 112 is turned off after the process in step S15 is executed.

Figure 7:
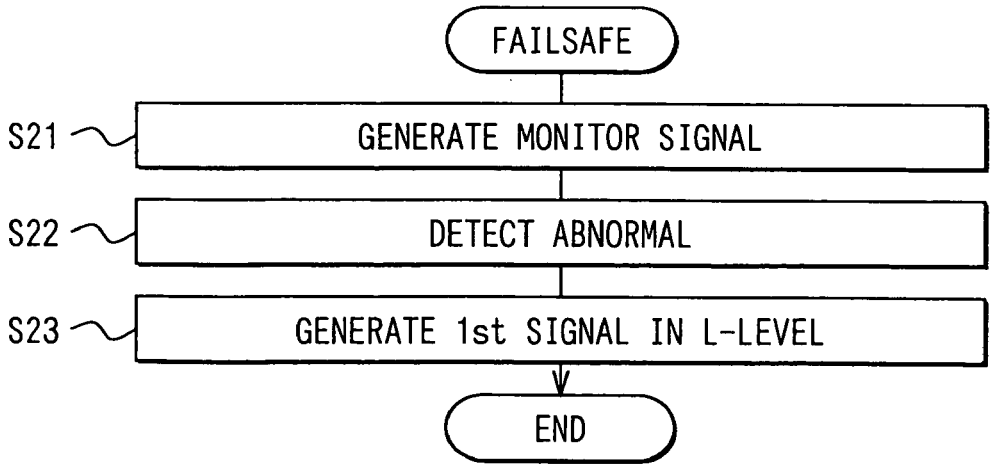
FIG. 7 is a flowchart showing a failsafe operation of the motor driver according to the first embodiment.

Referring to a flowchart shown in FIG. 7, a fail-safe operation of the motor driver 100 is described hereinafter.

When the earth fault is occurred at the connecting points 157 so that an over-current is supplied to the bridge circuit 156 and the coils 22, the detecting part 154 generates a monitor signal indicative of an abnormality in step S21. The power source control part 114 receiving the monitor signal determines that the current abnormality is detected based on the monitor signal in step S22. Then, the power source control part 114 generates the first power source signal in L-level in step S23. The first switch 130 opens the contact 137 to turn off the power source of the driving circuit 150. According to this embodiment, the power source control part 114 keeps the second power source control signal in H-level, which causes the contacts 147 of the second switch 140 to be opened so that the power source of the main control part 112 is kept on.

The control circuit 110, the first switch 130, and the second switch 140 correspond to a power source control means, and the control circuit 110, the switch sensor 118 and the key-sensor 119 correspond to a detecting means in the present invention.

According to the first embodiment, when the insert operation of the ignition key is detected before the cranking of the engine, the power source of the driving circuit 150 and the main control part 112 are turned on to drive the motor 12 based on the main control signal. Thereby, the valve timing is kept in the cranking valve timing at the time of engine cranking. The insert operation of the ignition key prior to the cranking command causes the power source to be turned on, and causes the motor 12 to be energized. Thereby, the period in which the power source is on and the motor 12 is energized before the cranking command is minimized so that electric power consumption is reduced. The insert operation of the ignition key causes the first and the second switch 130, 140 to be operated simultaneously, so that the power source of the driving circuit 150 and the main control part 112 are turned on at the same time. This simplifies the operation of the power source control part 114.

When the cranking command is detected, the driving circuit 150 and the motor 12 are activated according to the main control signal generated without respect to the rotation speed signal even if the first and the second rotation speed signal have not detected yet. Thereby, during the period from the engine cranking to the detection of the first and the second rotation speed signal, the after-start valve timing is continuously maintained.

According to the first embodiment, when the engine shutdown command is detected, the power source of the driving circuit 150 and the main control part 112 are turned on until the period T2 has passed. The driving circuit 150 drives the motor 12 according to the main control signal from the main control part 112 until the period T1 has passed, which is shorter than the period T2. Since the period T1 and the period T2 are longer than the period from the time when the ignition and the fuel injection are terminated to the engine running at a maximum speed to the time when the engine is completely stopped, the valve timing, in which the engine is completely off, is consistent with the cranking valve timing. Thus, the engine can be restarted in the cranking valve timing. Furthermore, since the period T1 and the period T2 are pre-stored, it is unnecessary to determine those periods. The power source control part 114 simultaneously controls the first switch 130 and the second switch 140, so that the power source of the driving circuit 150 and the main control part 112 are simultaneously turned off to simplify the process by the power source control part 114.

When the over-current is supplied to the driving circuit 150 and the motor 12, the power source of the driving circuit 150 is forcibly turned off to avoid malfunctions of the driving circuit 150 and the motor 12. The power source of the main control part 112 is independently controlled to be on, so that the main control part 112 can control the engine.

Second Embodiment

Figure 8:
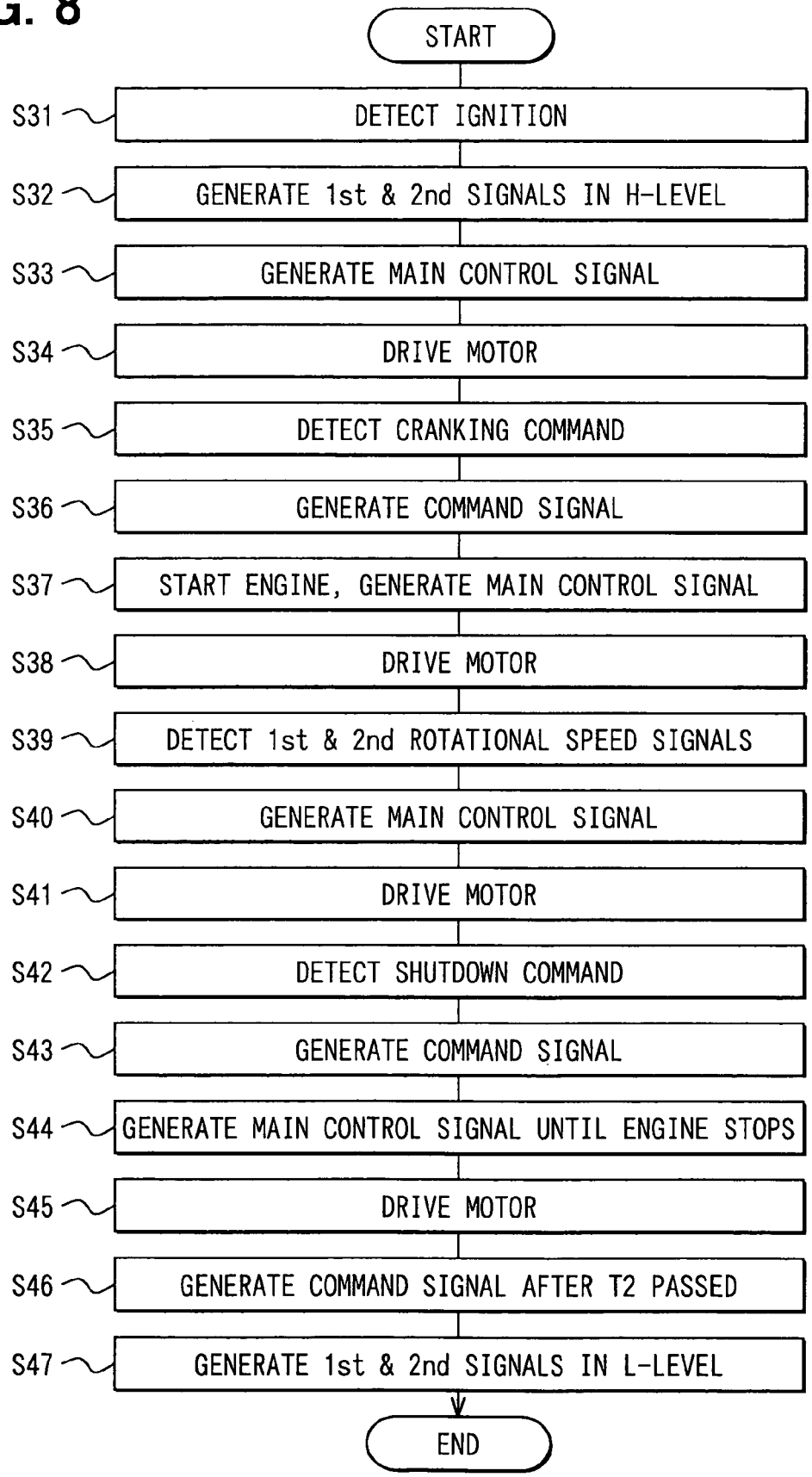
FIG. 8 is a flowchart showing an operation of the motor driver according to a second embodiment.

A second embodiment is a modification of the first embodiment. FIG. 8 is a flowchart showing the operation of the motor driver. In FIG. 8, step S31 to step S43 are the same processes as step S1 to step S13 in FIG. 1. The main control part 112 receiving the command signal generated in step S43 generates the main control signal with the engine running by inertia thereof until the engine is completely stopped in step S44. At this moment, the main control part 112 estimates time t1 in which the engine is completely stopped according to the first rotation speed and/or the second rotation speed. Then, the main control part 112 establishes the control target to realize the cranking valve timing at the time t1 based on the first and the second rotation speed signal or the detected signal by the Hall effect elements 18 in the case that no rotation speed signal is output. The main control signal indicative of the control target is generated. After the execution of the process in step S44, the processes in steps S45 to S47 which are the same processes as in steps S15 to S17 are executed. The period T2 in step S46 is longer than the period from the time when the ignition and the fuel injection are terminated with respect to the engine running at maximum speed to the time when the engine is completely stopped.

According to the second embodiment, since the motor 1 is energized even after the engine shutdown command is generated, the valve timing at the time t1 can be consistent with the cranking valve timing. The engine can be re-started in the condition in which the cranking valve timing is established.

Third Embodiment

Figure 9:
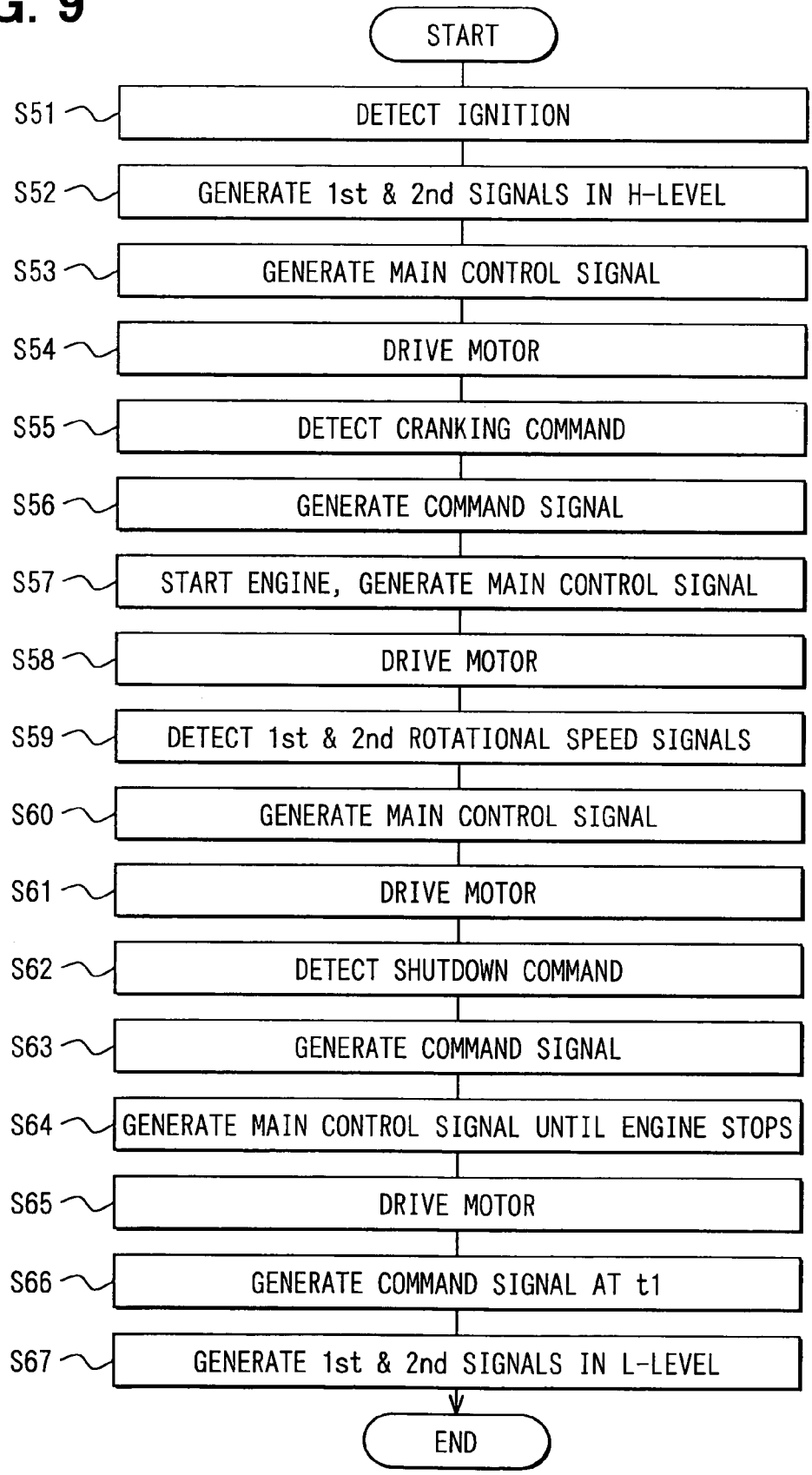
FIG. 9 is a flowchart showing an operation of the motor driver according to a third embodiment.

A third embodiment is a modification of the second embodiment. FIG. 9 is a flowchart showing an operation of the motor driver.

In FIG. 9, step S51 to step S65 are the same processes as step S31 to step S45 in FIG. 8. In step S66, the main control part 112 generates and sends a command signal to the power source control part 114 at the time t1. The power source control part 114 receiving the command signal generates the first power source control signal and the second power source control signal in step S67. The power source of the driving circuit 150 and the main control part 112 are turned off simultaneously.

According to the third embodiment, the power source of the driving circuit 150 and the main control part 112 are on until the engine is completely stopped, and the driving circuit 150 energizes the motor 12 according to the main control signal from the main control part 112. Thereby, the valve timing at the time t1 is consistent with the cranking valve timing. The engine can be restarted in a condition in which the cranking valve timing is established. Furthermore, the period, in which the power source of the driving circuit 150 and the main control part 112 are on after the shutdown command is generated, is consistent with the period in which the motor 12 is energized after the shutdown command is generated.

Fourth Embodiment

Figure 10:
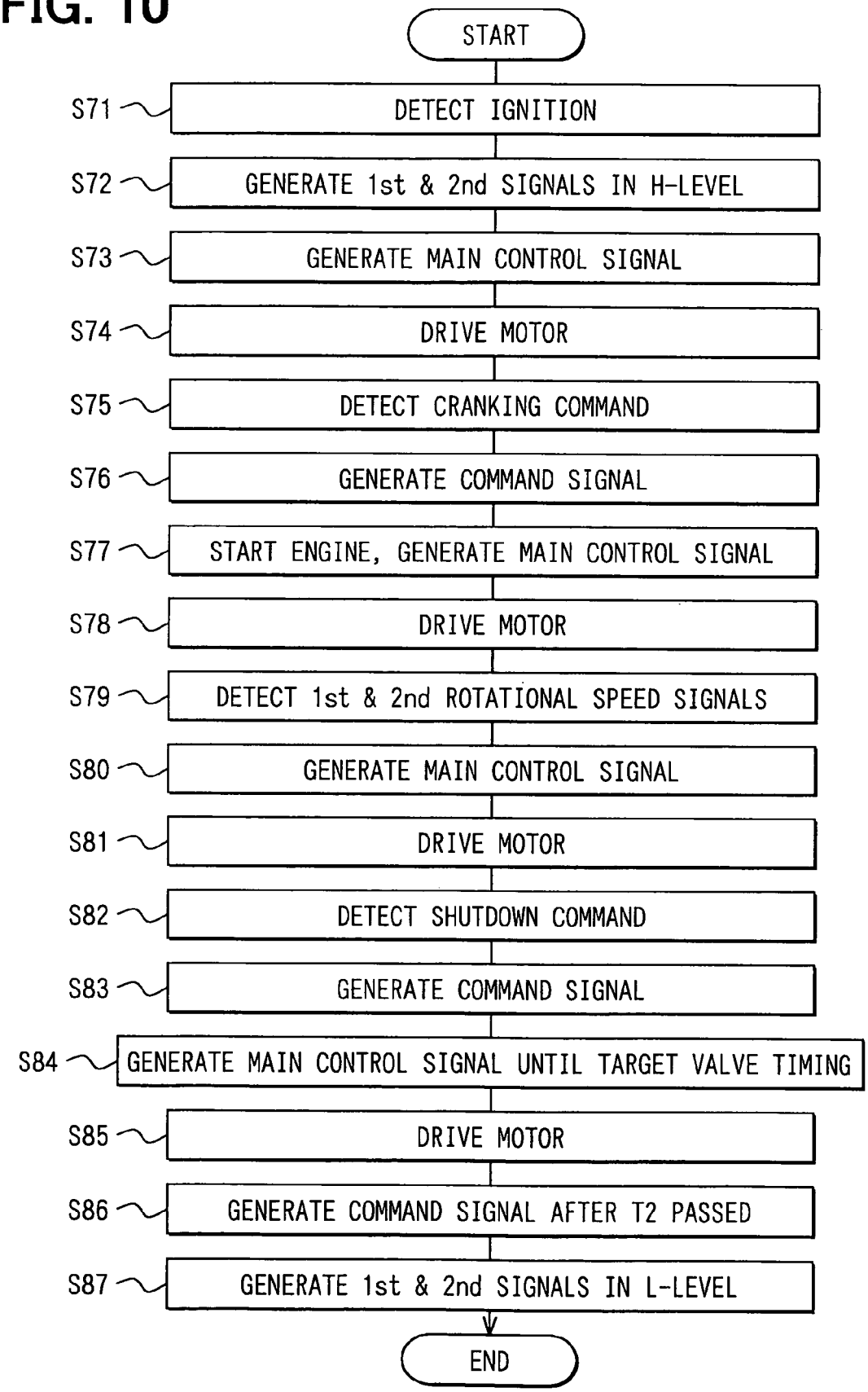
FIG. 10 is a flowchart showing an operation of the motor driver according to a fourth embodiment.

A fourth embodiment is a modification of the second embodiment. FIG. 10 is a flowchart showing an operation of the motor driver.

In FIG. 10, step S71 to step S83 are the same processes as step S31 to step S45 in FIG. 8. In step S84, the main control part 112 receiving the command signal generated in step S83 generates a main control signal with the engine running by its inertia until the valve timing is brought into be consistent with the target valve timing. The main control part 112 estimates the time t1, in which the engine is completely stopped, in the same manner as the process in step S44. The main control part 112 calculates a target valve timing at a time t2 prior to the time t1 in such a manner that the cranking valve timing can be established at the time t1 according to the first rotational speed signal and the second rotational speed signal. The main control part 112 generates the main control signal indicative of the control target in which the target valve timing at the time t2 is established. After the execution of the process in step S84, the processes in steps S45 to S47 that are the same process as in steps S15 to S17 are executed.

According to the fourth embodiment, the motor 12, which is deenergized at the time t2 after the shutdown command is generated, serves as a load which varies the valve timing of the engine running by its inertia. At the time t1, the valve timing is brought into be consistent with the cranking valve timing. Thus, the engine can be re-started in the condition in which the cranking valve timing is established.

Fifth Embodiment

Figure 11:
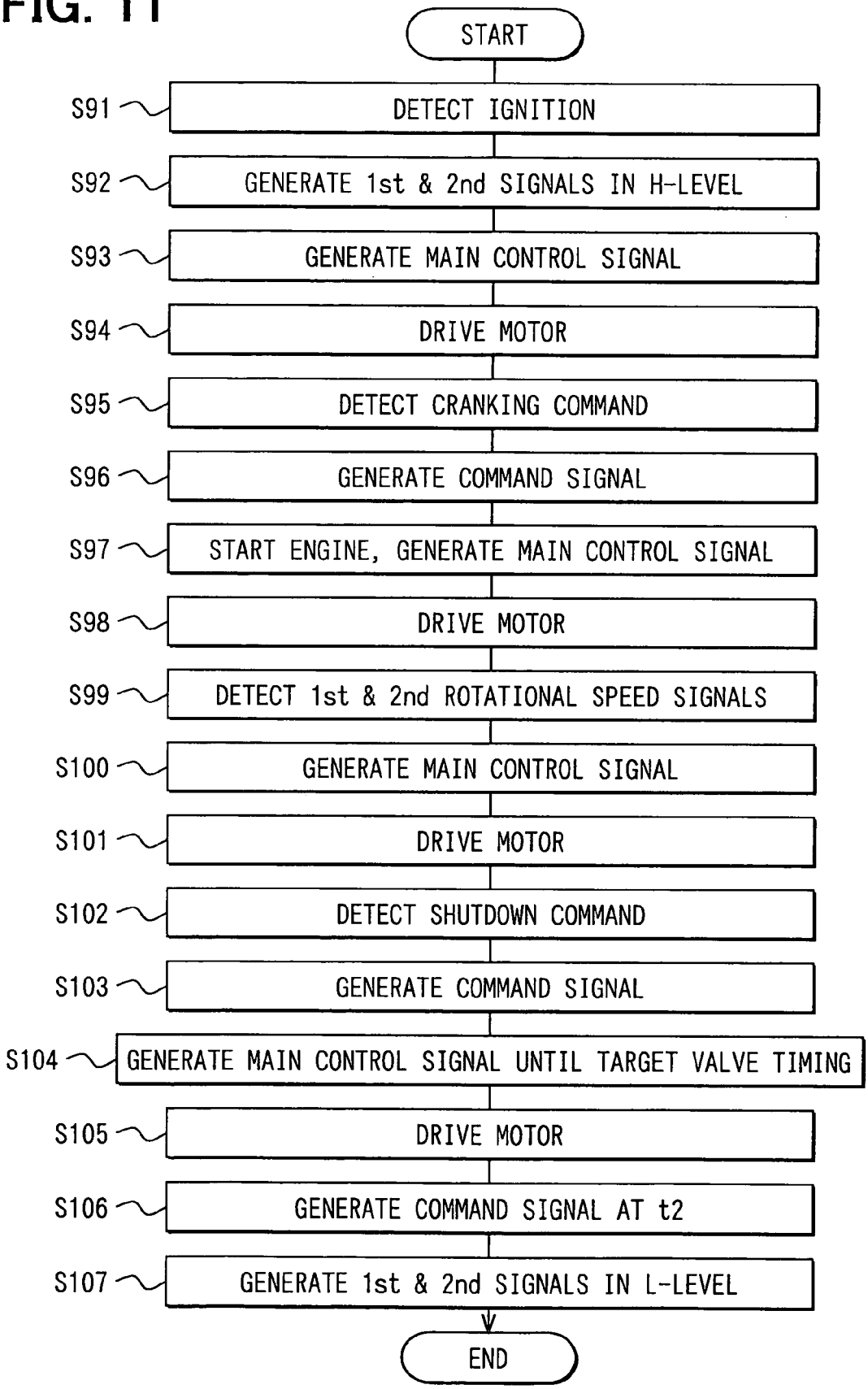
FIG. 11 is a flowchart showing an operation of the motor driver according to a fifth embodiment.

A fifth embodiment is a modification of the fourth embodiment. FIG. 11 is a flowchart showing an operation of the motor driver.

In FIG. 11, step S91 to step S105 are the same processes as step S71 to step S85 in FIG. 10. In step S106, the main control part 112 generates and sends the command signal to the power source control part 114. The power source control part 114 generates the first and the second power source control signal in L-level in step S107, so that the power source of the driving circuit 150 and the main control part 112 are turned off simultaneously.

According to the fifth embodiment, the power source of the driving circuit 150 and the main control part 112 are turned on until the target valve timing is established at the time t2 in order to energize the motor 12 based on the main control signal even after the shutdown command of the engine is generated. The motor 12, which is deenergized at the time t2 after the shutdown command is generated, serves as a load which varies the valve timing of the engine running by its inertia. At the time t1, the valve timing is brought into be consistent with the cranking valve timing. Thus, the engine can be re-started in the condition in which the cranking valve timing is established. The period in which the power source of the driving circuit 150 and the main control part 112 is turned on after the shutdown command is generated is substantially consistent with the period in which the motor 12 is energized after the shutdown command is generated, so that the electric power consumption is reduced.

Sixth Embodiment

Figure 12:
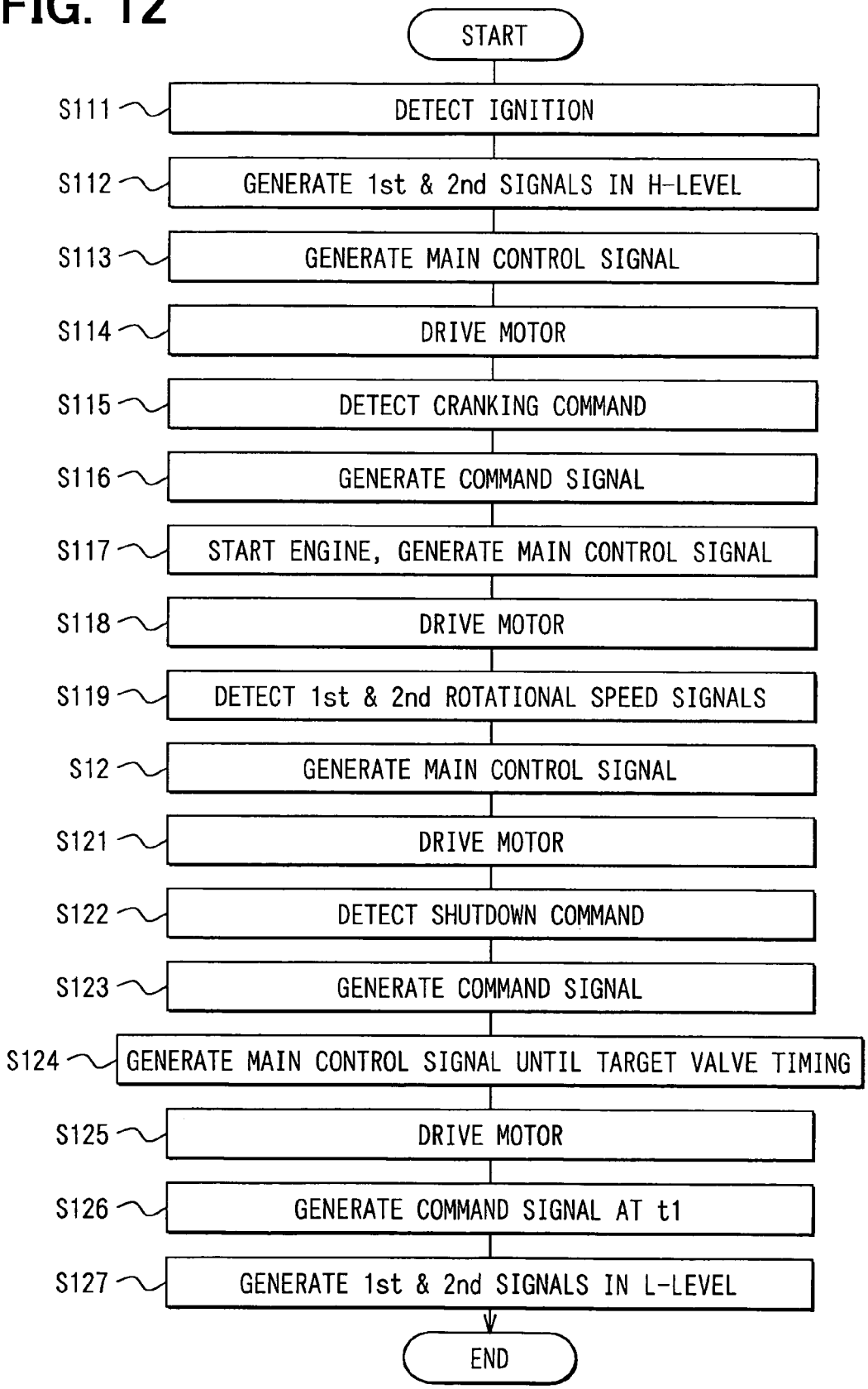
FIG. 12 is a flowchart showing an operation of the motor driver according to a sixth embodiment.

A sixth embodiment is a modification of the fourth embodiment. FIG. 12 is a flowchart showing an operation of the motor driver.

In FIG. 12, step S111 to step S125 are the same processes as step S71 to step S85 in FIG. 10. In step S126, the main control part 112 generates and sends the command signal to the power source control part 114 at the time t1 after the time t2. The power source control part 114 generates the first and the second power source control signal in L-level in step S107, so that the power source of the driving circuit 150 and the main control part 112 are turned off simultaneously.

According to the sixth embodiment, the power source of the driving circuit 150 and the main control part 112 are turned on until the engine is completely stopped. The motor 12 is energized based on the main control signal of the main control part 112 until the target valve timing is established at the time t2 prior to time t1 even after the shutdown command of the engine is generated. The motor 12, which is deenergized at the time t2 after the shutdown command is generated, serves as a load which varies the valve timing of the engine running by its inertia. At the time t1, the valve timing is brought into be consistent with the cranking valve timing. Thus, the engine can be re-started in the condition in which the cranking valve timing is established.

Seventh Embodiment

Figure 13:
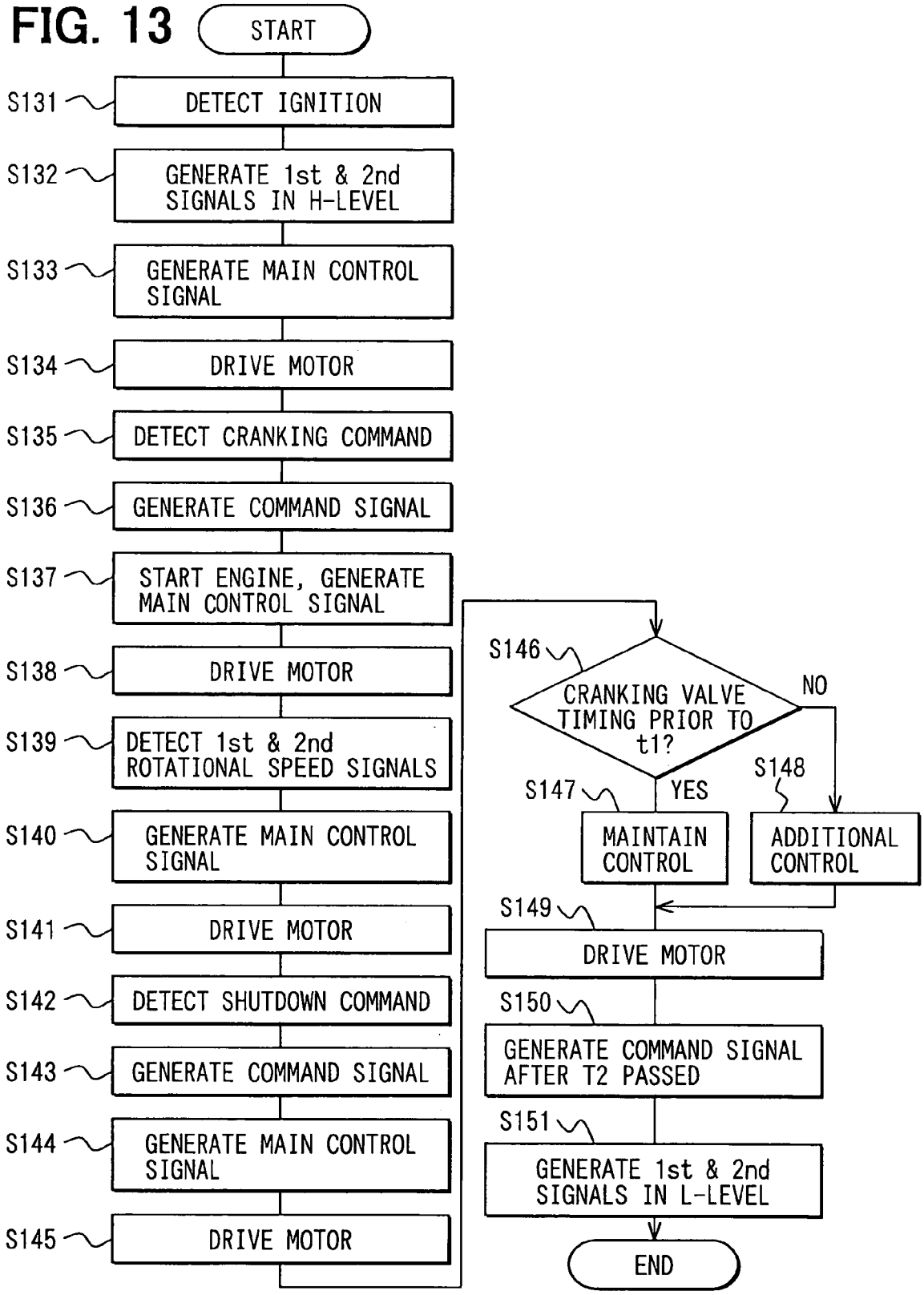
FIG. 13 is a flowchart showing an operation of the motor driver according to a seventh embodiment.

A seventh embodiment is a modification of the second embodiment. FIG. 13 is a flowchart showing the operation of the motor driver.

In FIG. 13, step S131 to step S143 are the same processes as step S31 to step S45 in FIG. 8. In step S144, the main control part 112 generates the main control signal with the engine running by its inertia until the process in step 147 or step S148 is executed. The main control part 112 estimates the time t1 and establishes the control target in the same way as the process in step S44 of the second embodiment. The current driving apart 152 receiving the main control signal generated by the main control part 112 energizes the motor 12 based on the main control signal in step S145. In step S146, the main control part 112 determines whether the valve timing is brought to be consistent with the cranking valve timing prior to the time t1. At this moment, the main control part 112 calculates the actual valve timing based on the first rotational speed signal and the second rotational speed signal or on the detected signal by the Hall effect elements 18. Then, the main control part 112 executes the above determination by comparing the calculated actual valve timing with the pre-stored cranking valve timing.

When it determines that the valve timing is consistent with the cranking valve timing prior to the time t1, the main control part 112 executes the maintaining control in step S147. In this maintaining control, the main control signal is generated which is indicative of the control target in order to maintain the cranking valve timing until the time t1 based on the first rotational speed signal and the second rotational speed signal or on the detected signal by the Hall effect elements 18 in the case that the first and the second rotational speed signal are not generated.

When it determines that the valve timing is consistent with the cranking valve timing prior to the time t1, an additional control is executed in step S148. In this additional control, the control target is additionally established until the valve timing is consistent with the cranking valve timing based on the detected signals by the Hall effect elements, and the main control signal indicative of the control target is generated.

After the execution of the process in step S147 or S148, the processes in steps S149 to S151, which corresponds to steps S45 to S47 in the second embodiment, are executed.

According to the seventh embodiment, the motor 12 is energized in such a manner that the valve timing at the time t1 is consistent with the cranking valve timing even after the engine shutdown command is generated. In the seventh embodiment, the cranking valve timing may be realized prior to the time t1 or may not be realized even after the time t1 due to disturbances. However, the motor 12 is energized until the engine is completely stopped, so that even if the cranking vale timing is realized prior to the time t1, the motor 12 is energized so as to maintain the cranking valve timing until the time t1. If the cranking valve timing is not realized even at the time t1, the motor 12 is energized until the cranking valve timing is realized. Thus, the engine can be re-started in the condition in which the cranking valve timing is established.

Eighth Embodiment

Figure 14:
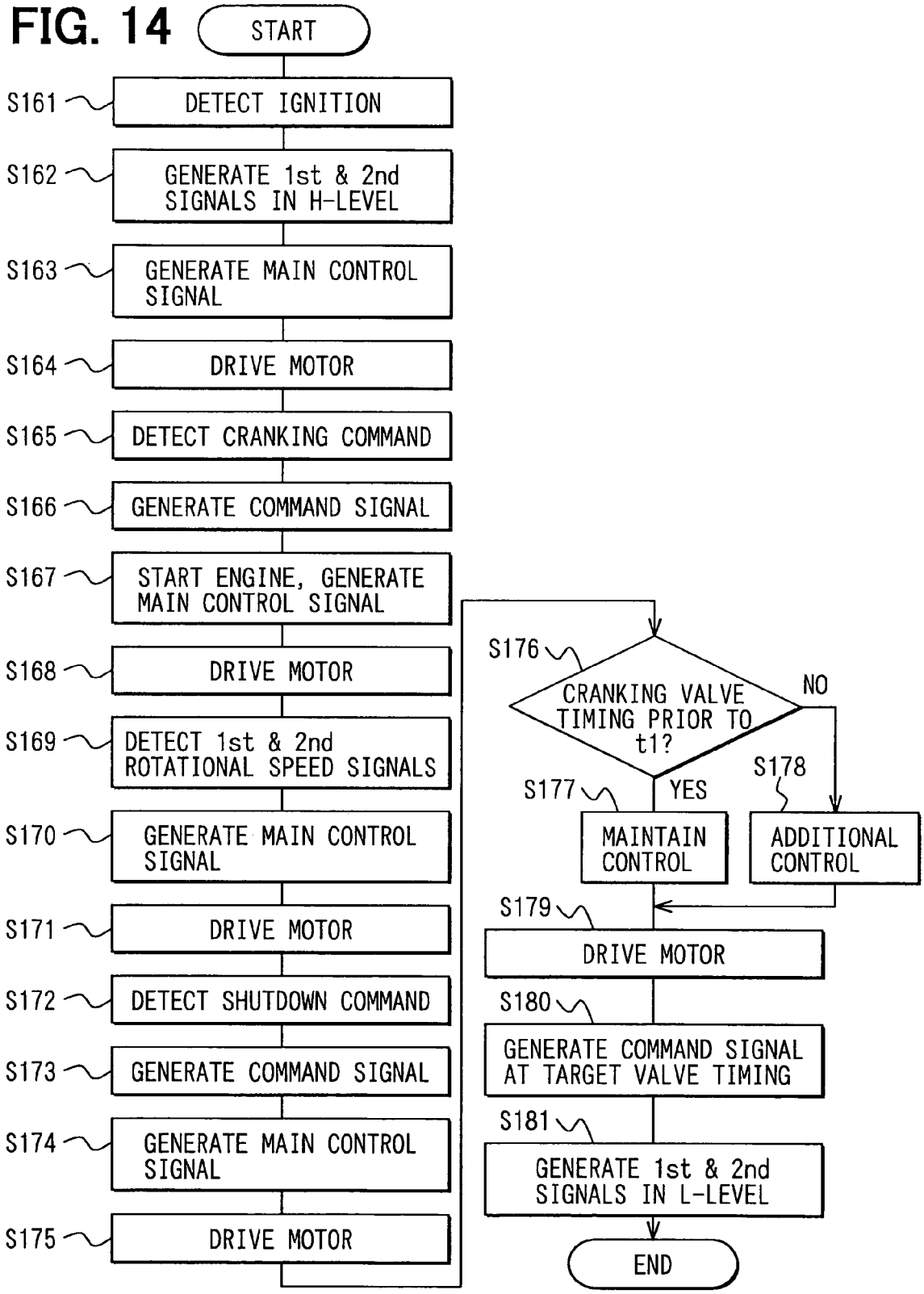
FIG. 14 is a flowchart showing an operation of the motor driver according to an eighth embodiment.

An eighth embodiment is a modification of the seventh embodiment. FIG. 14 is a flowchart showing the operation of the motor driver.

In FIG. 14, step S161 to step S179 are the same processes as step S131 to step S149 in the seventh embodiment. In step S180, the main control part 112 generates and sends the command signal to the power source control part 114 when the engine is completely stopped and the valve timing is consistent with the cranking valve timing. The power source control part 114 receiving the command signal generates the first and the second power source control signal in L-level in step S181, so that the power source of the driving circuit 150 and the main control part 112 are simultaneously turned off.

According to the eighth embodiment, even after the engine shutoff command is generated, the power source of the driving circuit 150 and the main control part 112 are turned on, and the driving circuit 150 energizes the motor 12 according to the main control signal from the main control part 112. Thereby, the cranking valve timing is maintained in the same manner as the seventh embodiment. The engine can be re-started in the condition in which the cranking valve timing is established. The period in which the power source of the driving circuit 150 and the main control part 112 are turned on is substantially equal to the period in which the motor 12 is energized after the engine shutdown command is generated, so that electric power consumption is reduced.

Ninth Embodiment

Figure 15:
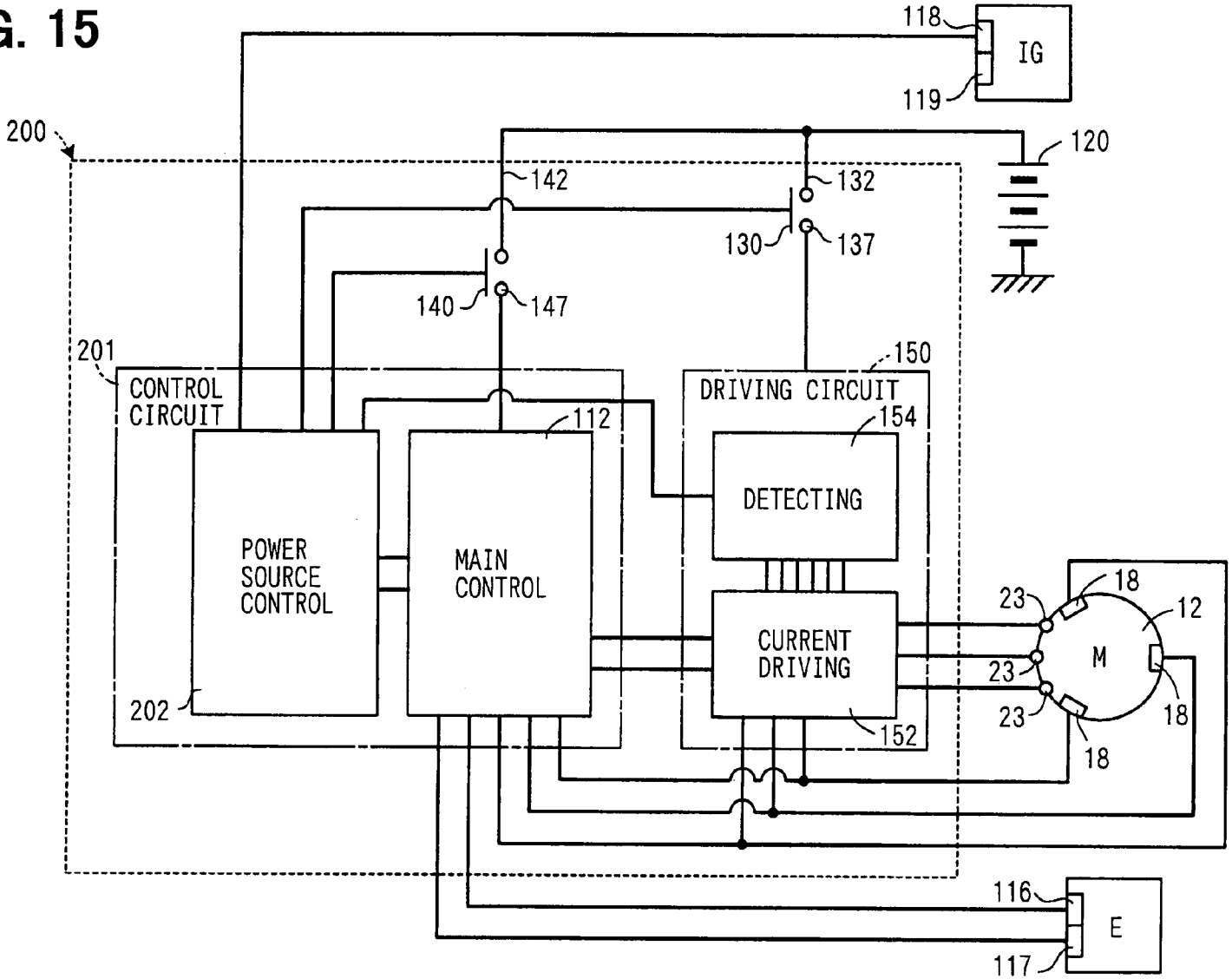
FIG. 15 is a block diagram showing the motor driver according to an eighth embodiment.

A ninth embodiment is a modification of the first embodiment. FIG. 15 schematically shows the motor driver according to the ninth embodiment.

Figure 16:
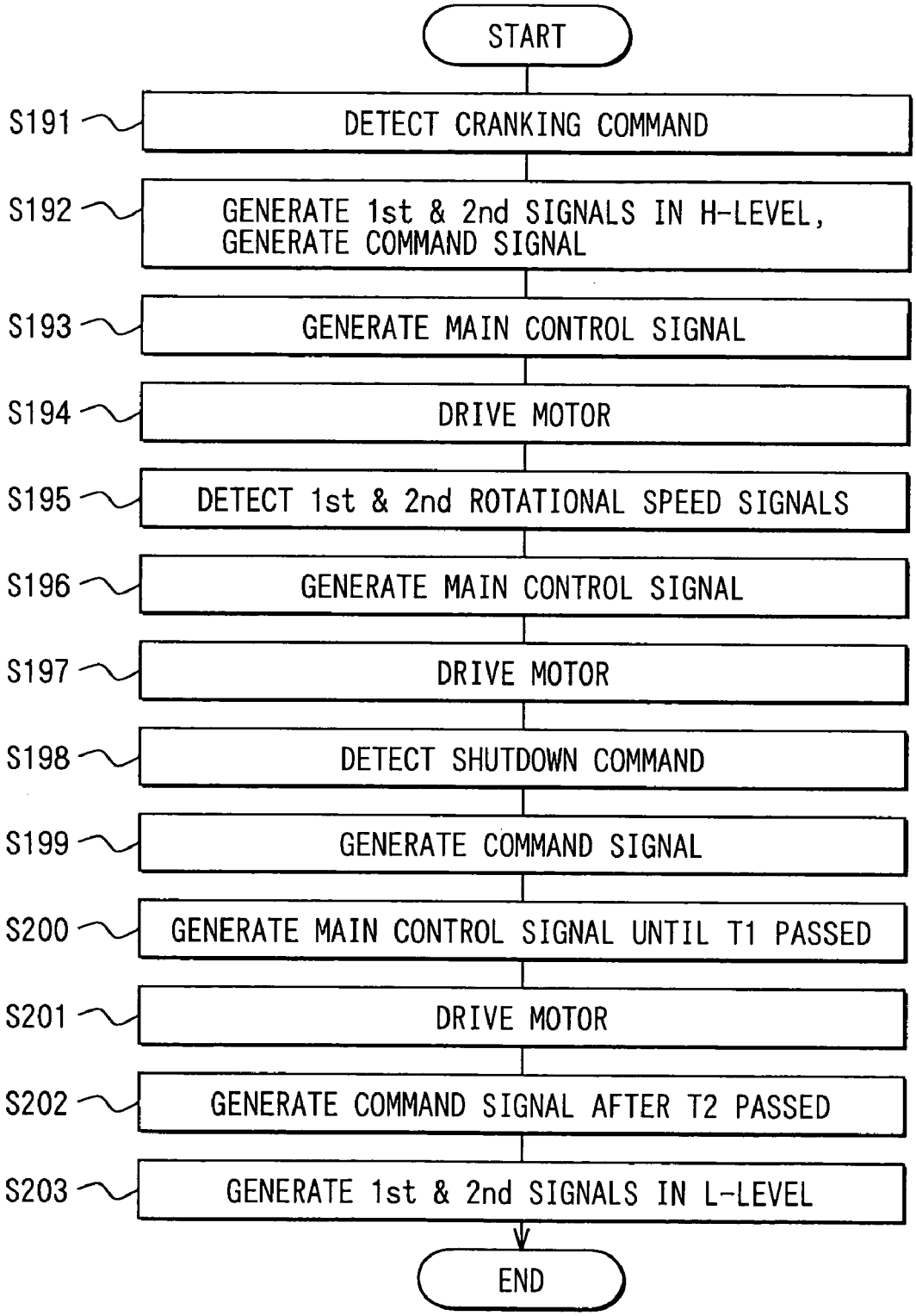
FIG. 16 is a flowchart showing an operation of the motor driver according to a ninth embodiment.
Figure 17:
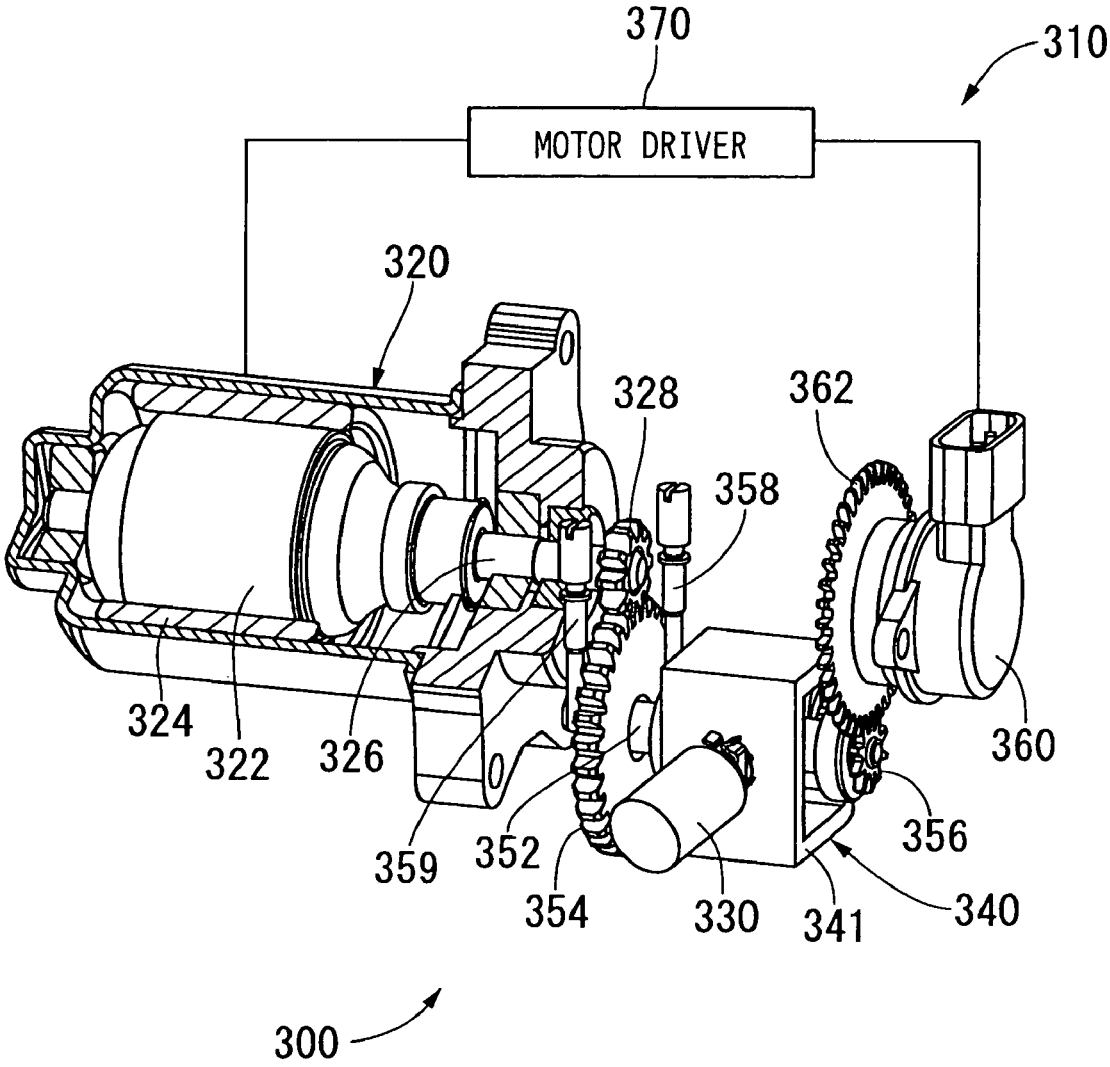
FIG. 17 is a partially cross sectional perspective view of an essential part of the valve lift adjuster according to a tenth embodiment.

In the motor driver 200, the power source control part 202 of the control circuit 201 is not connected to the key-sensor 119. As shown in FIG. 16, when the ignition switch is turned on with the engine off, the power source control part 202 receiving the signal in H-level from the switch sensor 118 determines that the engine start command is detected in step S191. Then, in step S192, the power source control part 202 generates and sends the first and the second power source control signal to the main control part 112. The first and the second power source control signal in H-level cause the contacts 137, 147 of the first and the second switch 130, 140 to be closed, so that the power source of the driving circuit 150 and the main control part 112 are simultaneously tuned on. The power source of the driving circuit 150 and the main control part 113 are maintained on until a process in step S203 or the failsafe operation is executed.

The main control part 112 receiving the command signal from the power source control part starts the engine, and generates the main control signal in step S193 in the same way as step S7 in the first embodiment. Then, the processes in steps S194 to S203 that are the same processes as in steps S8 to S17 of the first embodiment are executed. The control circuit 110 and the switch sensor 118 correspond to the detecting means in the present invention.

According to the ninth embodiment, the power source control part 202 simultaneously controls the first switch 130 and the second switch 140 to turn on the power source of the driving circuit 150 and the main control part 112, so that the control process by the power source part 202 can be simplified.

Tenth Embodiment

FIGS. 17 to 21 shows a valve lift adjuster according to a tenth embodiment. The valve lift adjuster 300 adjusts a maximum value of an intake valve lift, which is one of the valve characters, using a rotational torque of a motor 320.

The valve lift adjuster 300 includes an actuator 310 which drive a control axis member 330 in an axial direction thereof, and a lift adjusting mechanism (not shown) which adjusts the maximum valve lift amount according to a position of the control axis member 330. The actuator shown in FIG. 7 comprises the motor 320, control axis member 330, a transfer portion 340, a driving cam 350 (shown in FIG. 19), an angle sensor 360, and a motor driving apparatus 370.

The motor 320 is a DC-motor, which comprises a rotor 322 on which a coil is wound, and a permanent magnet 324 which covers an outer surface of the rotor 322. A motor gear 328 is provided at an end of a motor shaft 326, which rotates with the rotor 322.

Figure 18:
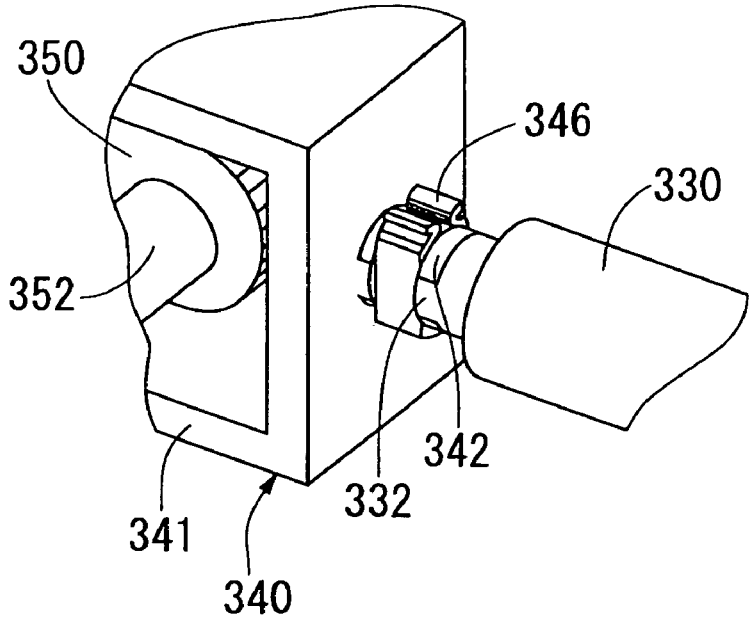
FIG. 18 is a perspective view showing an essential part of an actuator according to the tenth embodiment.
Figure 19:
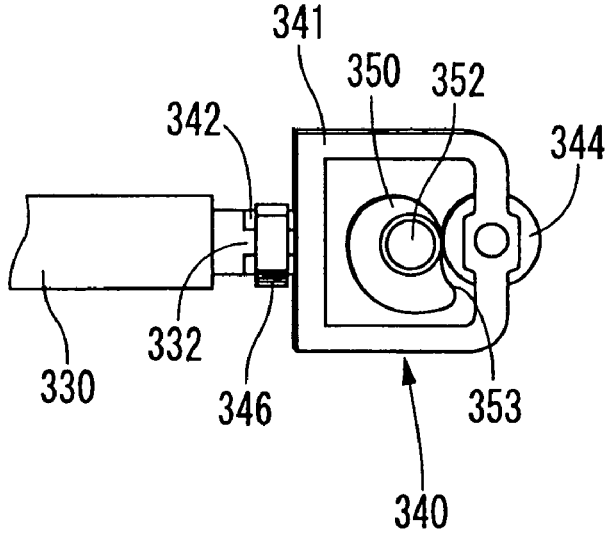
FIG. 19 is a side view showing an essential part of the actuator according to the tenth embodiment.

The control axis member 330 is connected to a supporting flame 341 of the transfer portion 340 at one end thereof, and is connected to a lift adjusting mechanism at the other end thereof. The control axis member 330 is crossing substantially perpendicularly to the motor shaft 326. As shown in FIGS. 18, 19, a connecting portion 332, which is one end of the control axis member 330, is engaged with and connected to a connecting portion 342 of the supporting flame 341. A clip 346 is provided between the connecting portion 332 and the connecting portion 342 to connect both of the connecting portions 332, 342.

The transfer portion 340 comprises the supporting flame 341 which is square box-shaped, and a roller 344 which is rotatably supported by the supporting flame 341 at an opposite side relative to the control axis member 330. A camshaft member 352 of the driving cam 350 is inserted into the inside of the supporting flame 41. The driving cam 350 has a cam surface 353 which is in contact with the roller 344. A cam gear 354 and a cam gear 356 are respectively provided at both ends of the camshaft member 352. The cam gear 354 engages with the motor gear 328 to form a reduction mechanism. The cam axis member 352 is disposed in parallel to the motor shat 326. A rotational angle range of the cam gear 354 is restricted is such a manner that two projections (not shown) provided on the gear 354 are brought into contact with engaging members 358, 359.

An angle sensor 360 has a sensor gear 362 which engages with the cam gear 356. The angle sensor 360 detects a rotation angle of a sensor rotation member (not shown) engaging with the sensor 362 with the sensor rotation member and the Hall effect elements. The angle sensor 360 sends a detected signal to the motor driver 370.

The motor driver 370 energizes the coil of the rotor 322 to drive the motor shaft 326 in normal/reverse direction.

The operation of valve lift adjuster 300 is described hereinafter. When the motor shaft 326 is rotated, the torque of the motor 320 is transferred to the driving cam 350 through the motor gear 328 and the cam gear 354. When the driving cam 350 rotates, contacting with the roller 344, the supporting flame 341 reciprocates in an axial direction of the axis member 330. The valve lift adjusting mechanism adjusts the maximum valve lift according to the position of the axis member 330, which moves along the cam profile of the cam surface 353 of the riving cam 350.

The motor driver 370 has the almost same structure as the motor driver 100 of the first embodiment except following structure. The same parts and components as those in the motor driver 100 are indicated with the same reference and the same descriptions will not be reiterated.

Figure 20:
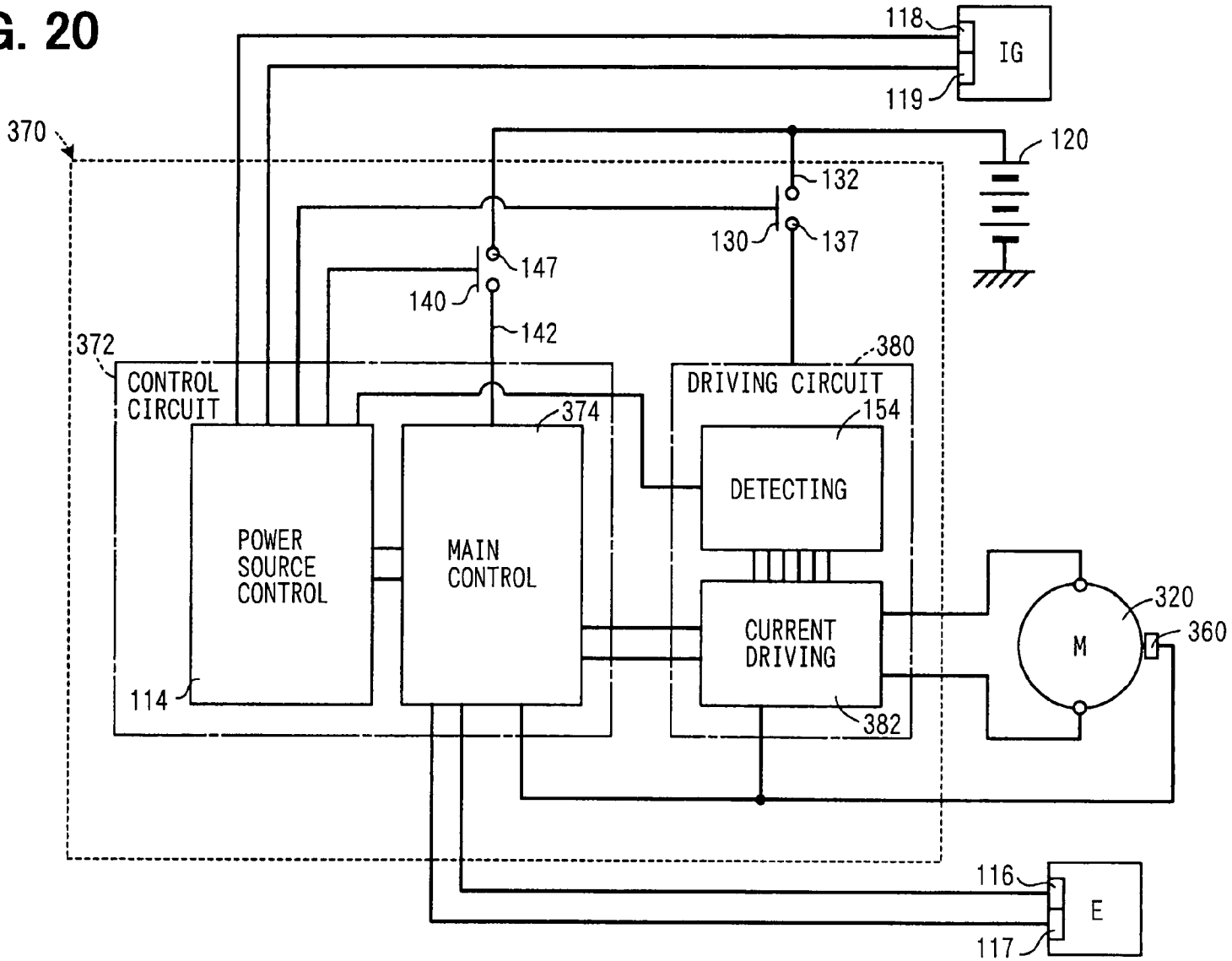
FIG. 20 is a block diagram showing the motor driver according to the tenth embodiment.

Referring to FIG. 20, the main control part 374 of the control circuit 372 establishes the control target to drive the motor 320 in order to realize the maximum valve lift amount which is suitable to the current engine condition. The main control part 374 receives a detected signal from the angle sensor 360.

Figure 21:
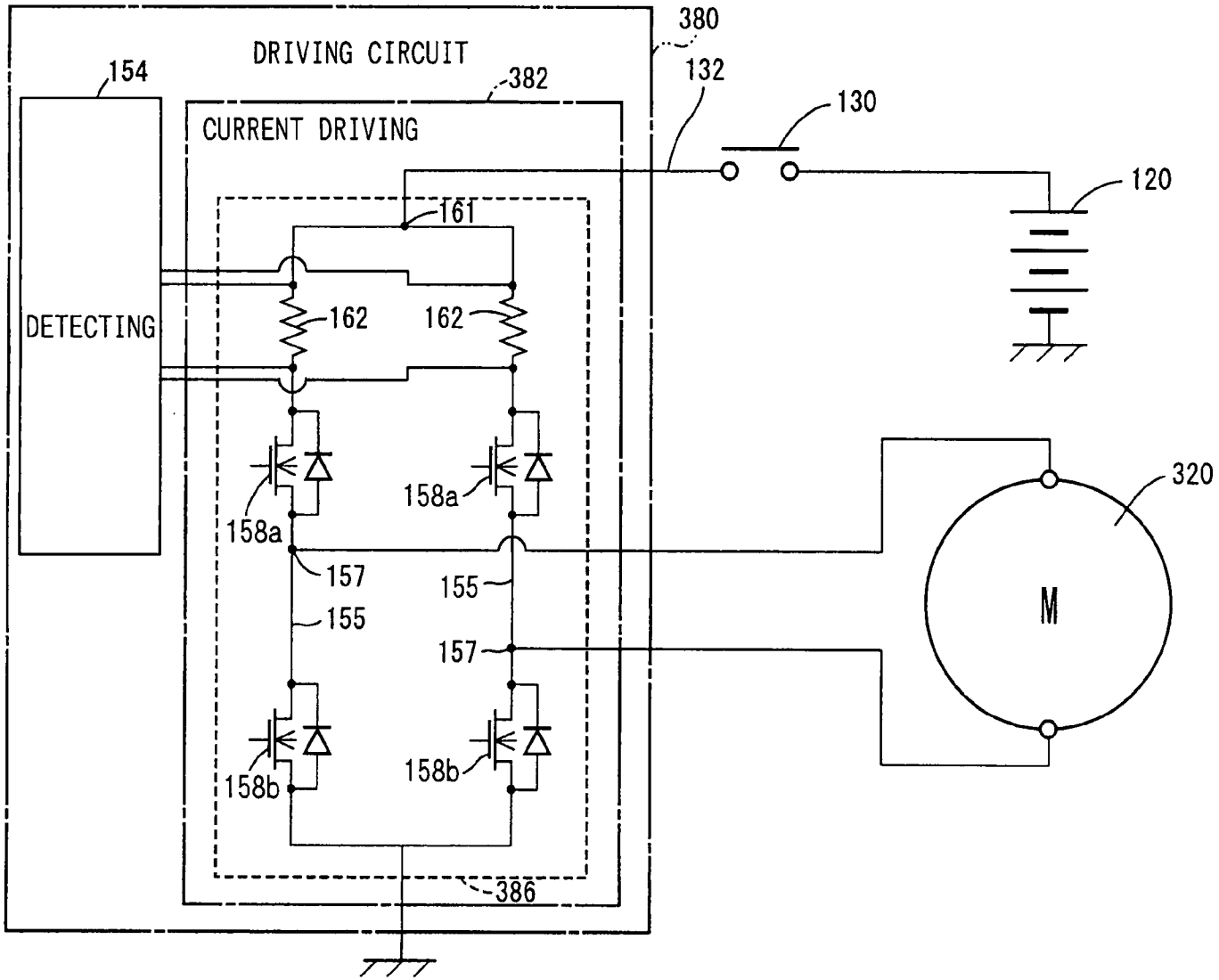
FIG. 21 is a circuit diagram showing a current driving part according to the tenth embodiment.

The current driving part 382 of the driving circuit 380, as shown in FIG. 21, has a bridge circuit 386 which eliminated one row of the arms 155 from the bridge circuit 156 of the first embodiment. The current driving part 382 receives a detected signal from the angle sensor 360 which is connected thereto. The current driving part 382 establishes a switching pattern and turns on/off the switching elements 158*a*, 158*b* according to the switching pattern to energize the motor 320, so that the control target represented by the main control signal is realized.

The motor driver 370 conducts almost the same operation as the first embodiment. The main control part 374 establishes the control target based on the detected signal by the angle sensor 360 in order to realize the cranking valve lift that is a maximum valve lift required at the engine starting in step corresponding to step S3 of the first embodiment. The current driving part 382 executes step corresponding to step S4, so that the maximum valve lift amount is consistent with the cranking valve lift amount. In step corresponding to step S7, the main control part 374 establishes the control target based on the detected signal by the angle sensor 360 in order to realize the after-start valve lift amount which is the maximum valve lift amount required after the engine is turned on. The current driving part 382 executes step corresponding to step S8 to cause the maximum valve lift amount to be consistent with the after-start valve lift amount. In step corresponding to step S10, the main control part 374 establishes the control target based on the first and the second rotational speed signal in order to realize the suitable maximum valve lift amount. The current driving part 382 executes step corresponding to step S11 to hold or change the maximum valve lift amount to the suitable amount for the engine. In step corresponding to step S14, the main control part 374 established the control target to realize the cranking valve lift amount based on the first and the second rotational speed signal or a detected signal by the angle sensor 360 in the case that the rotational speed signals are not generated. The current driving part 382 executes step corresponding to step S15, whereby the maximum valve lift is brought into be consistent with the cranking valve lift amount and be kept.

The motor driver 370 conducts the same failsafe operation as the first embodiment.

In the tenth embodiment, the control circuit 372, the first switch 130, and the second switch 140 correspond to a power source control means. The control circuit 372, the switch sensor 118 and the key-sensor 119 correspond to a detecting means of the present invention.

According to the tenth embodiment, when the insert operation of the ignition key is detected before the engine start command is generated, the power source of the driving circuit 380 and the main control circuit 374 are turned on to energize the motor 320. Thereby, the maximum valve lift amount is kept in the cranking valve lift amount, so that the cranking valve lift amount is realized at the time of stating the engine.

When the engine-start command is detected, the driving circuit 380 energizes the motor 320 according to the main control signal which is generated without respect to the first and the second rotational speed signal even before the first and the second rotational speed signal are generated. Thereby, the after-start valve lift amount is continuously maintained until the first and the second rotational speed signal are detected.

When the engine shutdown signal is detected, the power source of the driving circuit 380 and the main control part 374 are turned on until the period T2 has passed in order to drive the motor 320 until the period T1 has passed. Thereby, the maximum valve lift amount can be consistent with the cranking valve lift amount at the time when the engine is completely stopped, so that the engine can be re-started in the condition in which the cranking valve lift amount is established. Furthermore, when the over-current is passed through the driving circuit 380 and the motor 320 under the normal operation, the failsafe operation is executed to turn off the power source of the driving circuit 380, so that the malfunction of the driving circuit 380 and the motor 320 can be avoided.

[Modification]

In the first to tenth embodiments, the non-contact relay comprised of a semiconductor circuit can be used as the first and the second switch 130, 140. No failsafe operation can be executed. The power source control part 114 can generate the fist and the second power source signal in H-level to turn on the power source of the driving circuit 150 and the main control part 112 based on a braking operation by a driver, an operation of fastening a seatbelt, or stepping operation of a clutch by the driver instead of the insert operation of the ignition key. In this case, a sensor detecting the operation above is connected to the power source part 114, 202 to send the detected signal thereto. The power sources of the main control part 114, 202 and the driving circuit 150, 380 can be respectively independently controlled so that the on-off timing of each power source can be deviated. In the ninth embodiment, before the engine start command is generated, that is, before step S191, the power source control part 202 can generates the first power source control signal in L-level and the second power source signal in H-level, so that the power source of the main control part 112 can be turned on prior to the power source of the driving circuit 150. In the first to the tenth embodiment, the engine can be replaced by a hybrid engine. The three-phase motor can be replaced by the other known motor.

In the first embodiment, step S12 to step S17 can be skipped. In the ninth embodiment, step S192, step S193, and step S194 can be skipped. In this case, the motor 12 is energized when the rotational speed of the crankshaft and the camshaft become under the lowest value detected by the first and the second rotational speed sensor 116, 117. In the ninth embodiment, step S198 to step S203 can be replaced by steps S42 to S47 of the second embodiment, steps S62 to S67 of the third embodiment, steps S82 to S87 of the fourth embodiment, steps S102 to S107 of the fifth embodiment, steps S122 to S127 of the sixth embodiment, steps S142 to S181 of the seventh embodiment, or steps S172 to S181 to the eighth embodiment. Furthermore, steps S198 to S203 can be skipped.

In the tenth embodiment, the valve lift amount can be adjusted with respect to the exhaust valve. Steps corresponding to steps S12 to S17 can be skipped. The normal operation that is same as in the second to ninth embodiments can be executed by the motor driver 370. When the operation corresponding to that of the second and the third embodiment is executed, the main control part 374 establishes the control target to realize the cranking valve lift amount at the time t1 in step corresponding to step S44 or step S64. When the operation corresponding to that of the fourth, the fifth, or the sixth embodiment is executed, the main control part 374 calculates the control target in such a manner that the cranking valve lift amount is realized at the time t1. In the tenth embodiment, when the operation corresponding to that of the seventh or eighth embodiment is executed, the main control part 374 establishes the control target, and determines whether the maximum valve lift amount is consistent with the cranking valve lift amount in step corresponding to step S146 or S176. In the tenth embodiment, the operation corresponding to that of the seventh or eighth embodiment is executed, the main control part 374 establishes the control target in step corresponding to step S147 or S177, and in step corresponding to S148 or S178 the main control part 374 establishes the control target. In the tenth embodiment, when the operation corresponding to that of the eighth embodiment is executed, the main control part 374 generates and sends the command signal to the power control part 114.

What is claimed is:

1. A valve controller for adjusting valve opening/closing in an internal combustion engine by utilizing motor torque, the valve controller comprising:

detecting means for detecting a shutdown command to the internal combustion engine;

a driving circuit energizing a motor;

a power source control means for turning a power source of the driving circuit on/off after the detecting means detects the shutdown command;

the power source control means including a switch turning the power source of the driving circuit on/off and a control circuit controlling the switch;

wherein the driving circuit energizing the motor generates a monitor signal which indicates a condition of current passing through the motor, and the control circuit turns off the power source of the driving circuit by controlling the switch when an abnormal current passing through the motor is detected based on the monitor signal.

2. A valve controller for adjusting valve opening/closing in an internal combustion engine by utilizing motor torque, the valve controller comprising:

a detecting means for detecting a cranking command to the internal combustion engine;

a driving circuit energizing a motor before the cranking command is detected;

a power source control means turning a power source of the driving circuit on before the cranking command to the internal combustion engine is detected; and a sensor for detecting rotation speed of a rotor of the motor;

wherein the power source control means controls the motor based on rotation speed of the rotor before the detecting means detects the cranking command.

3. A valve controller as in claim 2, wherein:

the detecting means detects an operation to a vehicle before the cranking command is generated, and the power source control means turns the power source of the driving circuit on until the cranking command has been detected after the operation to the vehicle has been detected by the detecting means.

4. A valve controller as in claim 2, wherein:

the power source control means turns the power source of the driving circuit on during a period between a time before and a time after the cranking command has been detected by the detecting means.

5. A valve controller as in claim 2, wherein:

the power source control means includes a switch turning the power source of the driving circuit on/off, and a control circuit controlling the switch.

6. A valve controller as in claim 5, wherein:

the control circuit generates a control signal in a main control part thereof, and the driving circuit energizes the motor based on the control signal.

7. A valve controller as in claim 6, wherein:

the power source control means includes a first switch, a second switch turning the power source of the main control part on/off, and a control circuit controlling the first switch and the second switch, and the control circuit turns the power source of the driving circuit and the main control part on by simultaneously controlling the first switch and the second switch after the cranking command has been detected by the detecting means.

8. A valve controller as in claim 2, wherein:

the driving circuit energizes the motor before the cranking command has been detected by the detecting means.

9. A valve controller as in claim 8, wherein:

the detecting means detects an operation to a vehicle before the cranking command is generated, and the power source control means turns the power source of the driving circuit on until the cranking command has been detected after the operation to the vehicle has been detected by the detecting means.

10. A valve controller as in claim 8, wherein:

the detecting means detects a rotational speed signal of the internal combustion engine, and the driving circuit energizes the motor before the detecting means detects the rotational speed signal of the internal combustion engine.

11. A valve controller as in claim 10, wherein:

the driving circuit energizes the motor until the rotational speed signal has been detected after the cranking signal has been detected by the detecting means.

12. A valve controller as in claim 10, wherein:

the detecting means includes a control circuit which generates a control signal based on the rotational speed signal if the rotational speed signal is detected, and generates a control signal without respect to the rotational speed signal if no rotational speed signal is detected, and the driving circuit energizes the motor based on the control signal.

13. A valve controller for adjusting valve opening/closing in an internal combustion engine by utilizing motor torque, the valve controller comprising:

detecting means for detecting a cranking command to the internal combustion engine;

a driving circuit energizing a motor; and a power source control means turning the power source of the driving circuit on before a cranking command to the internal combustion engine has been detected;

the power source control means including a switch turning the power source of the driving circuit on/off, and a control circuit controlling the switch;

wherein the driving circuit energizing the motor generates a monitor signal which indicates a condition of current passing through the motor, and the control circuit turns the power source of the driving circuit off by controlling the switch when an abnormal current passing through the motor is detected based on the monitor signal.

14. A valve controller for adjusting valve opening/closing in an internal combustion engine by utilizing motor torque, the valve controller comprising:

detecting means for detecting a rotational speed signal of the internal combustion engine;

a driving circuit energizing a motor before the rotational speed signal is detected by the detecting means; and a sensor for detecting rotation speed of a rotor of the motor;

wherein the motor is controlled based on rotation speed of the rotor before the detecting means detects a cranking command of the internal combustion engine.

15. A method for controlling adjustment of valve opening/closing in an internal combustion engine by utilizing motor torque, the method comprising:

detecting a cranking command to the internal combustion engine;

energizing a motor before the cranking command is detected;

turning power source of the driving circuit on before the cranking command to the internal combustion engine is detected; and detecting rotation speed of a rotor of the motor;

wherein the motor is controlled based on rotation speed of the rotor before the cranking command has been detected.

16. A method for controlling adjustment of valve opening/closing in an internal combustion engine by utilizing motor torque, the method comprising:

detecting a rotational speed signal of the internal combustion engine;

energizing a motor before the rotational speed signal is detected; and detecting rotation speed of a rotor of the motor;

wherein the motor is controlled based on rotation speed of the rotor before a cranking command of the internal combustion engine is detected.

* * * * *